US008840239B2

(12) United States Patent
Yasuda

(10) Patent No.: US 8,840,239 B2
(45) Date of Patent: Sep. 23, 2014

(54) IMAGE FORMING DEVICE, IMAGE FORMING SYSTEM, AND STORAGE MEDIUM THAT STORES A CONTROL PROGRAM OF AN IMAGE FORMING DEVICE

(75) Inventor: Megumi Yasuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 338 days.

(21) Appl. No.: 13/113,860

(22) Filed: May 23, 2011

(65) Prior Publication Data

US 2012/0092432 A1 Apr. 19, 2012

(30) Foreign Application Priority Data

Oct. 14, 2010 (JP) ..... 2010-231898

(51) Int. Cl.
*B41J 2/00* (2006.01)
*B41J 11/00* (2006.01)

(52) U.S. Cl.
CPC ..... *B41J 11/003* (2013.01)
USPC ..... 347/104

(58) Field of Classification Search
CPC ..... B41J 2/00
USPC ..... 347/104
See application file for complete search history.

(56) References Cited

U.S. PATENT DOCUMENTS 6,213,659 B1 * 4/2001 Elgee ..... 400/633
6,829,465 B2 * 12/2004 Yamanaka et al. ..... 399/301
2002/0149805 A1 10/2002 Tanaka et al.
2005/0087010 A1 * 4/2005 Nojiri et al. ..... 73/159
2005/0174379 A1 8/2005 Nakazawa et al.
2006/0284967 A1 * 12/2006 Nomura et al. ..... 347/238
2009/0309905 A1 * 12/2009 Yoshioka et al. ..... 347/8
2010/0238250 A1 * 9/2010 Kachi ..... 347/104

FOREIGN PATENT DOCUMENTS

JP 2002-292960 A 10/2002
JP 2005-205759 A 8/2005
JP 2007-322772 A 12/2007
JP 2008-149657 A 7/2008
JP 2009-229541 A 10/2009

OTHER PUBLICATIONS

Office Action issued by Japanese Patent Office in counterpart Japanese Application No. 2010-231898, dated Jun. 3, 2014.

* cited by examiner

*Primary Examiner* — Alessandro Amari
*Assistant Examiner* — Alexander C Witkowski
(74) *Attorney, Agent, or Firm* — Sughrue Mion, PLLC

(57) ABSTRACT

An image forming device is provided. The image forming device includes: a forming component that forms an index, at a formation position, on a recording medium that is conveyed in a first direction and passes the formation position; an acquiring component that acquires measurement results, from a measuring component, of a width, along a second direction that intersects the first direction, of the recording medium; and a formation control component that carries out control that causes the index to be formed by the forming component at a position that is at one end portion side, along the second direction, of the recording medium, and that is apart, along the second direction and by a distance corresponding to the width acquired by the acquiring component, from a formation reference position that is set at another end portion side, along the second direction, of the recording medium, is provided.

17 Claims, 17 Drawing Sheets

IMAGE FORMING DEVICE, IMAGE FORMING SYSTEM, AND STORAGE MEDIUM THAT STORES A CONTROL PROGRAM OF AN IMAGE FORMING DEVICE

CROSS-REFERENCE TO RELATED APPLICATIONS

This application is based on and claims priority under 35 USC 119 from Japanese Patent Application No. 2010-231898 filed on Oct. 14, 2010.

BACKGROUND

1. Technical Field

The present invention relates to an image forming device, an image forming system, and a control program of an image forming device.

2. Related Art

There exists a technique in which a sheet position offset sensor, that detects the position of the end of a sheet by a pair of elements that are a light-emitting element and a light-receiving element, is disposed at a sheet conveying path of an image forming device main body, and the position of the sheet end is detected by the sheet position offset sensor, and the writing start position of an image to be printed is controlled on the basis of the results of detection.

An object of the present invention is to provide an image forming device, an image forming system, and a control program of an image forming device that can suppress fluctuations in a region of forming an index on a recording medium due to the effects of dispersion in widths of recording media, as compared with a case in which an index is not formed at a position that is separated by a distance, that corresponds to results of measuring the width along a second direction of a recording medium, from a formation reference position that is set at one end portion side along the second direction that intersects a first direction of the recording medium that is conveyed in the first direction.

SUMMARY

According to an aspect of the present invention, an image forming device is provided. The image forming device includes: a forming component that forms an index, at a formation position, on a recording medium that is conveyed in a first direction and passes the formation position; an acquiring component that acquires measurement results, from a measuring component, of a width, along a second direction that intersects the first direction, of the recording medium on which the index is formed by the forming component; and a formation control component that carries out control that causes the index to be formed by the forming component at a position that is at one end portion side, along the second direction, of the recording medium, and that is apart, along the second direction and by a distance corresponding to the width acquired by the acquiring component, from a formation reference position that is set at another end portion side, along the second direction, of the recording medium.

BRIEF DESCRIPTION OF THE DRAWINGS

Exemplary embodiments of the present invention will be described in detail based on the following figures, wherein.

DETAILED DESCRIPTION

Figure 1:
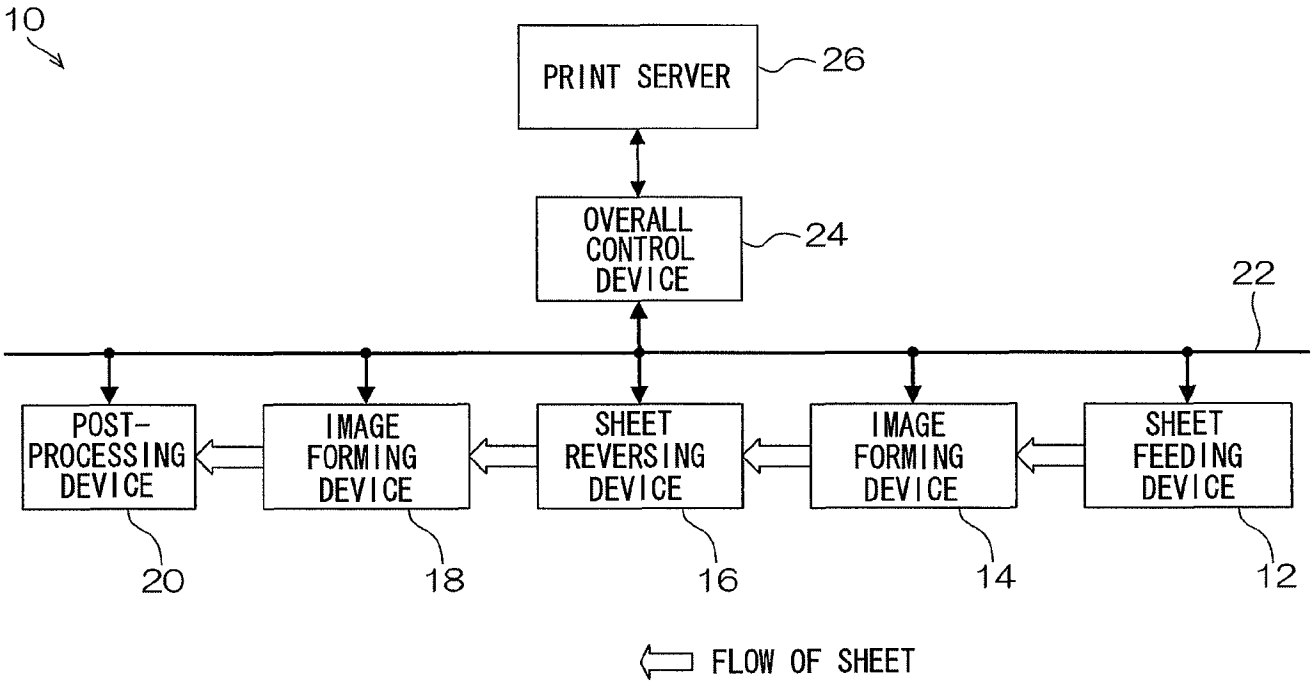
FIG. 1 is a block diagram showing the schematic structure of an image forming system that is described in the exemplary embodiments.

Examples of exemplary embodiments of the present invention are described hereinafter in detail with reference to the drawings. An image forming system 10 relating to the present exemplary embodiment is shown in FIG. 1. The image forming system 10 is a system that forms images on both surfaces of an elongated continuous sheet that is an example of the recording medium in the present invention. A sheet feeding device 12, an image forming device 14, a sheet reversing device 16, an image forming device 18 and a post-processing device 20 are provided in that order along the conveying direction of the sheet at the image forming system 10.

The sheet feeding device 12 feeds a sheet (an elongated continuous sheet), that has been loaded therein, toward the device at the downstream side in the sheet conveying direction. The image forming device 14 forms images on one surface of the sheet fed from the sheet feeding device 12. Further, the sheet reversing device 16 reverses, by a turning bar mechanism or the like, the obverse and the reverse of the sheet on whose one surface images were formed at the image forming device 14. The image forming device 18 forms images on the other surface (the surface on which images have not yet been formed) of the sheet whose obverse and reverse were reversed at the sheet reversing device 16. Due thereto, images are fanned on both surfaces of the sheet. The post-processing device 20 carries out post-processings such as cutting the sheet, on whose both surfaces images have been formed, into units of pages, and the like.

Note that the image forming system 10 may be structured such that a buffer device, that absorbs the difference in the processing speeds of the devices before and after by accumulating a predetermined amount of the continuous sheet, is further provided at at least one of the stage before and the stage after the image forming devices 14, 18. Further, the image forming system 10 may be structured such that a pre-processing device, that carries out at least one of various types of pre-processings (e.g., the formation of punch holes or perforations (dot-shaped holes that are used as cut lines, or the like) on the sheet, is further provided between the sheet feeding device 12 and the image forming device 14.

Further, the sheet feeding device 12, the image forming device 14, the sheet reversing device 16, the image forming device 18, and the post-processing device 20 are respectively connected to a bus 22. An overall control device 24, that is formed from a computer or the like, also is connected to the bus 22. The respective devices connected to the bus 22 transmit and receive signals and information via the bus 22, and the overall control device 24 controls the operations of the respective devices through the bus 22. Further, the overall control device 24 is connected to a print server 26 and client terminals via a communication medium such as a network or the like (only the print server 26 is shown in FIG. 1). The overall control device 24 receives, from the print server 26 or the like, image data expressing images that are to be formed on the sheet, and, among the received image data, transfers, to the image forming device 14, the image data expressing the images that are to be formed on the sheet by the image forming device 14, and transfers, to the image forming device 18, the image data expressing the images that are to be formed on the sheet by the image forming device 18.

The image forming devices 14, 18 are examples of image forming devices relating to the present invention, and the image forming system 10 is an example of the image forming system relating to the present invention. Further, the image forming device 14 also functions as an example of the first image forming device in the image forming system relating to the present invention, and the image forming device 18 also functions as an example of the second image forming device in the image forming system relating to the present invention.

Figure 2:
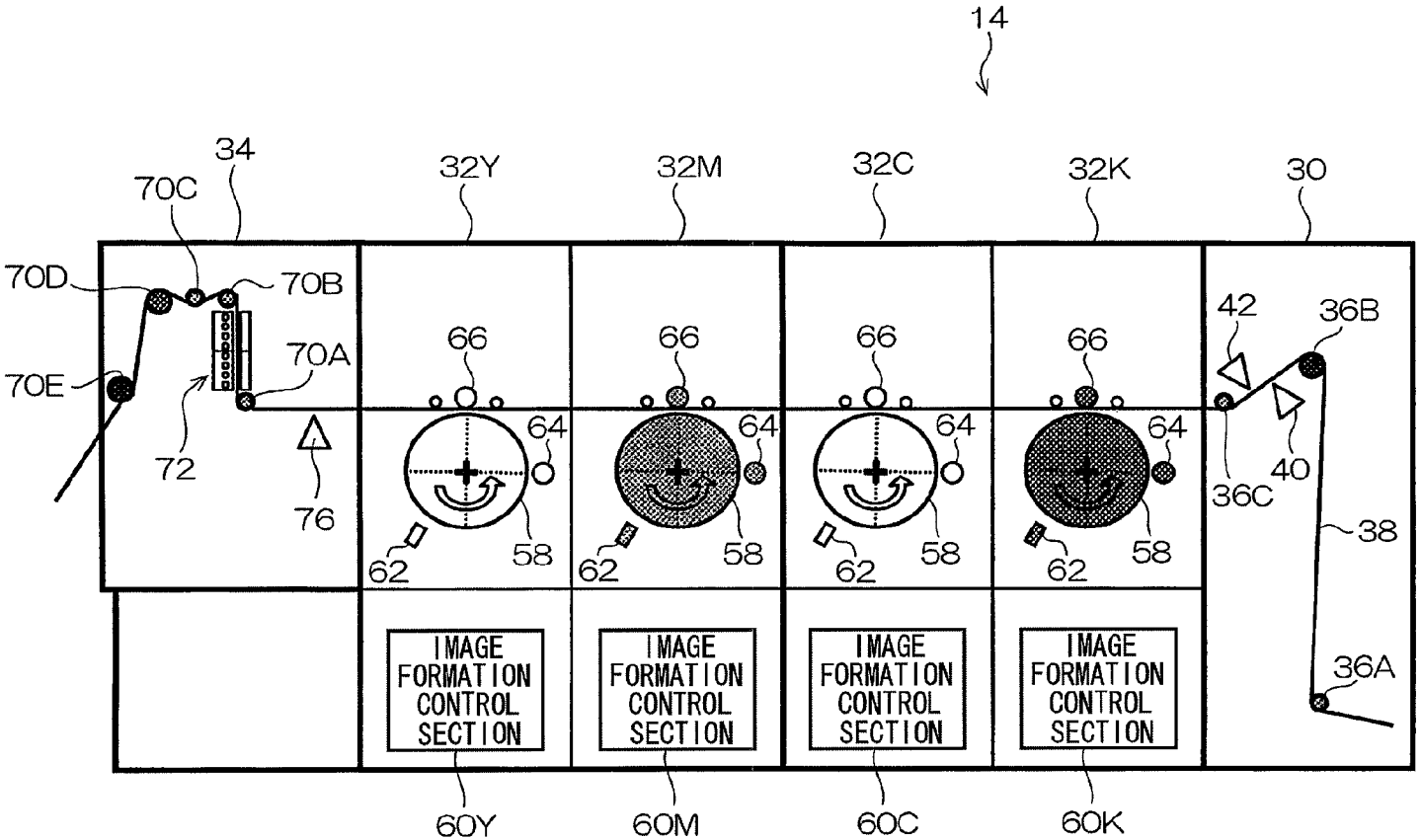
FIG. 2 is a schematic structural drawing of an image forming device.

In the present exemplary embodiment, the image forming devices 14, 18 have the same structure. To describe the structure by using the image forming device 14 as an example hereinafter, as shown in FIG. 2, a sheet feeding section 30, an image forming section 32K, an image forming section 32C, an image forming section 32M, an image forming section 32Y, and an image fixing section 34 are provided in the image forming device 14 in that order along the conveying direction of the sheet. Note that the image forming sections 32K through 32Y are examples of forming components relating to the present invention.

Plural conveying rollers 36A through 36C are provided at the sheet feeding section 30 in that order along a sheet conveying path. A sheet 38, that is fed into the sheet feeding section 30 from the device at the upstream side, is guided by guiding members and trained around the plural conveying rollers 36A through 36C respectively. Conveying forces are imparted to the sheet 38 by the conveying rollers 36A through 36C, and the sheet 38 is conveyed toward the downstream side of the sheet conveying path.

Figure 3:
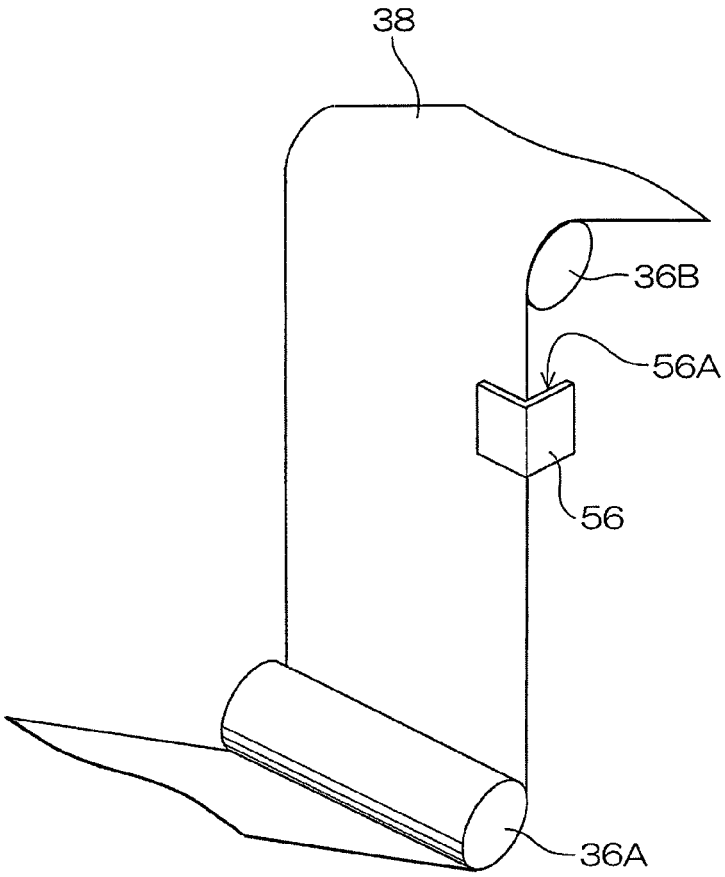
FIG. 3 is a perspective view showing a conveying reference member that is provided midway along a sheet conveying path.

The image forming device 14 (and the image forming device 18) relating to the present exemplary embodiment is structured so as to carry out sheet conveying by using, as a reference in sheet conveying (a conveying reference end surface, see FIG. 6 also), the end surface that is positioned at the right side, as seen from the downstream side of the sheet conveying path, of the transverse direction both end surfaces of the sheet 38 that is conveyed on the sheet conveying path. As shown in FIG. 3, a conveying reference member 56, at which is formed a reference surface 56A that is approximately parallel to the sheet conveying direction and approximately orthogonal to the transverse direction of the sheet 38, is provided between the conveying rollers 36A, 36B at the side portion, at the conveying reference end surface side, of the sheet 38 that is conveyed on the sheet conveying path. Between the conveying rollers 36A, 36B, the conveying reference end surface of the sheet 38 that is conveyed on the sheet conveying path collides against the reference surface 56A of the conveying reference member 56, and the sheet 38 is thereby conveyed with the state, in which the position of the conveying reference end surface coincides with the position of the reference surface 56A, maintained as is.

Note that the position at which the conveying reference member 56 is provided is an example of the "collision position that is further toward an upstream side in the conveying direction of the recording medium than the formation position", and the conveying reference member 56 is an example of the collision member.

Page position prescribing mark detecting sensors 40, 42, that are for detecting page position prescribing marks 90 (see FIG. 11, details described later) that are formed at one transverse direction end portion of the sheet 38, are respectively provided at the both sides of the sheet conveying path along the thickness direction of the sheet 38 that is conveyed on the sheet conveying path. The page position prescribing mark detecting sensors 40, 42 are reflecting-type light sensors having a light-emitting element formed from an LED or the like for example, and a photoelectric converting element (e.g., a photodiode or the like) that receives light that is emitted from the light-emitting element and reflected at the sheet 38. The page position prescribing mark detecting sensor 40 detects the page position prescribing mark 90 that is formed on the image formation surface of the sheet 38 at the image forming device 14. The page position prescribing mark detecting sensor 42 detects the page position prescribing mark 90 that is formed on the surface of the sheet 38 opposite the image formation surface. Note that the page position prescribing mark detecting sensors 40, 42 are provided at positions that are offset along the sheet conveying direction, and also function as examples of plural measuring components.

Figure 4:
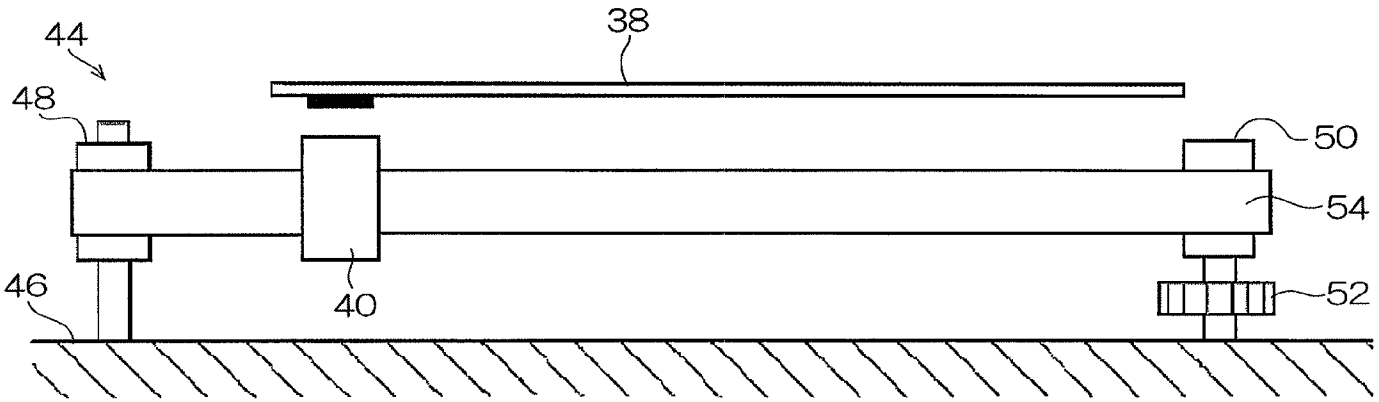
FIG. 4 is a side view showing the structure of a sensor moving device.

Further, the page position prescribing mark detecting sensor 40 is mounted to a sensor moving device 44 shown in FIG. 4. The sensor moving device 44 has a driven pulley 48 and a driving pulley 50 that are disposed at both sides of the sheet conveying path along the transverse direction of the sheet 38 conveyed along the sheet conveying path, and that are respectively supported by and rotate at a frame 46. A gear 52 is mounted to the rotating shaft of the driving pulley 50, and the driving pulley 50 is rotated by the driving force of a sensor moving motor that is transmitted via the gear 52. Note that, in the present exemplary embodiment, the sensor moving motor is structured by a pulse motor. An endless belt 54 is trained around the driven pulley 48 and the driving pulley 50, and the page position prescribing mark detecting sensor 40 is mounted to the belt 54. Accordingly, when the driving pulley 50 is rotated by the driving force of the senor moving motor, the belt 54 rotates, the page position prescribing mark detecting sensor 40 moves in the transverse direction of the sheet 38, and, accompanying this, the range of detection of the page position prescribing mark 90 by the page position prescribing mark detecting sensor 40 also moves in the transverse direction of the sheet 38.

Note that the page position prescribing mark detecting sensor 42 also is mounted to the sensor moving device 44 of the above-described structure, and is moved in the transverse direction of the sheet 38 due to the driving force of a sensor moving motor. Accompanying this, the range of detection of the page position prescribing mark 90 also is moved in the transverse direction of the sheet 38.

The image forming sections 32K, 32C, 32M, 32Y form images of respectively different colors (K (black), C (cyan), M (magenta), Y (yellow), respectively) on the sheet 38 by the electrophotographic method. A photoreceptor drum 58 is provided at each of the image forming sections 32K, 32C, 32M, 32Y, and a charging section, an exposure section, a developing section, a transfer section, a cleaning section, and a charge removing section are disposed in that order at the outer periphery of the photoreceptor drum 58 along the rotating direction of the photoreceptor drum 58. Further, image formation control sections 60K, 60C, 60M, 60Y are respectively provided.

The charging section charges the peripheral surface of the photoreceptor drum 58. The exposure section forms, on the peripheral surface of the photoreceptor drum 58, an electrostatic latent image corresponding to an image of a specific color, by exposing the peripheral surface of the photoreceptor drum 58 by light modulated in accordance with the image of the specific color that is to be formed on the sheet 38. Note that the present exemplary embodiment describes an aspect in which the exposure section includes an exposure head 62 (see FIG. 2) at which plural light-emitting elements respectively formed from LEDs or the like are arrayed in a row and the arrayed direction of the light-emitting elements is disposed parallel to the axis of the photoreceptor drum 58 (the main scanning direction of the electrostatic latent image to be formed on the peripheral surface of the photoreceptor drum 58), and the exposure section carries out exposure in units of one line of the image by controlling the lighting and extinguishing of the respective light-emitting elements of the exposure head 62. However, the exposure section may be a structure that uses an LD (laser diode) or the like as the exposure light source, and successively modulates laser light emitted from the exposure light source, and scans the peripheral surface of the photoreceptor drum 58 parallel to the axis of the photoreceptor drum 58, thereby carrying out image exposure.

Further, due to the developing section supplying toner of the specific color onto the peripheral surface of the photoreceptor drum 58 by a developing roller 64 (see FIG. 2) and developing the electrostatic latent image, the developing section forms a toner image of the specific color on the peripheral surface of the photoreceptor drum 58. The transfer section transfers the toner image of the specific color, that is formed on the peripheral surface of the photoreceptor drum, onto the sheet by a transfer roller 66 (see FIG. 2). Further, the residual toner on the peripheral surface of the photoreceptor drum 58, that was not transferred onto the sheet, is removed by the cleaning section, and the charge removing section removes charges from the peripheral surface of the photoreceptor drum 58. The image formation control sections 60 control the operations of the respective sections of the image forming sections including exposure by the exposure sections (the exposure heads 62), and the timings of the operations, so that the images of the respective colors that are formed respectively at the image forming sections 32K, 32C, 32M, 32Y are superposed one on another on the sheet 38.

Further, plural conveying rollers 70A through 70E are provided in that order along the sheet conveying path at the image fixing section 34. The sheet 38 that is discharged from the image forming section 32Y is guided by guiding members and trained around the plural conveying rollers 70A through 70E respectively, and conveying force is imparted to the sheet 38 by the conveying rollers 70A through 70E, and the sheet 38 is conveyed.

A flash fixing unit 72 is provided between the conveying roller 70A and the conveying roller 70B. The flash fixing unit 72 is provided with plural flash lamps whose longitudinal directions are disposed parallel to the transverse direction of the sheet 38, and that are for emitting flash light for supplying energy that fixes the toner images transferred on the sheet 38 (fuses the toner). The lighting of the individual flash lamps of the flash fixing unit 72 is controlled by a fixing control section 74 (see FIG. 5), and the flash lamps are made to emit light intermittently at preset time periods. Between the conveying roller 70A and the conveying roller 70B, the flash light emitted from the flash fixing unit 72 is illuminated onto the image formation surface of the sheet 38 that is conveyed within the image fixing section 34, and the toner of the toner images formed on the image formation surface is fused. The toner image is thereby fixed as an image. Thereafter, the sheet 38 is discharged to the exterior of the image forming device 14, and is fed to the downstream side device.

Further, in the present exemplary embodiment, marks 92 for color offset correction (see FIGS. 6 and 7, details described later) are respectively formed by the image forming sections 32K, 32C, 32M, 32Y at the end portion, at the conveying reference end surface side, on the image formation surface of the sheet 38. A color offset correction mark detecting sensor 76 for detecting the marks 92 for color offset correction is provided at the sheet conveying direction upstream side of the conveying roller 70A. The color offset correction mark detecting sensor 76 is a reflecting-type light sensor having a light-emitting element formed from an LED or the like for example, and a photoelectric converting element (e.g., a photodiode or the like) that receives the light that is emitted from the light-emitting element and reflected at the sheet 38. Further, the color offset correction mark detecting sensor 76 is attached to a sensor moving device 78 (see FIG. 5) that has a structure similar to that of the sensor moving device 44 that was described above. The color offset correction mark detecting sensor 76 is moved in the transverse direction of the sheet 38 by the driving force of a sensor moving motor of the sensor moving device 78, and, accompanying this, the range of detection of the marks 92 for color offset correction by the color offset correction mark detecting sensor 76 also moves in the transverse direction of the sheet 38.

Note that, in the present exemplary embodiment, the sensor moving motor of the sensor moving device 78 also is structured by a pulse motor. Further, the color offset correction mark detecting sensor 76 is an example of the detecting component of the present invention, and the sensor moving device 78 is an example of the moving component of the present invention.

Figure 5:
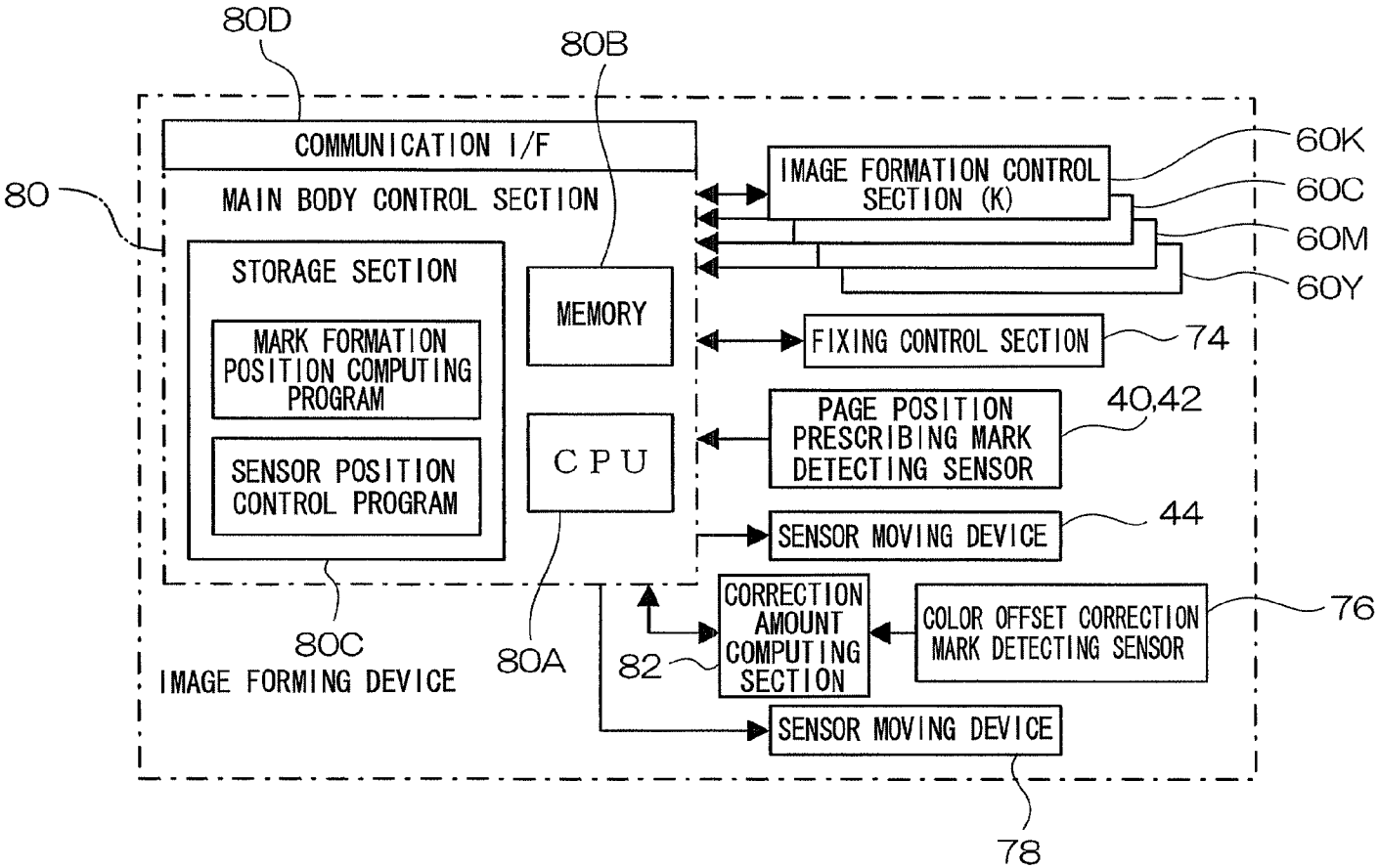
FIG. 5 is a block diagram showing the schematic structure of an electrical system of the image forming device.

As shown in FIG. 5, a main body control section 80 is provided at the image forming device 14. The main body control section 80 is formed from a microcomputer or the like, and has a CPU 80A, a memory 80B such as a ROM or a RAM or the like, a non-volatile storage section 80C formed from an HDD (Hard Disk Drive) or a flash memory or the like, and a communication OF (interface) section 80D that is connected to the bus 22 and governs communications with external devices. A mark formation position computing program for carrying out mark formation position computing processing that will be described later at the main body control section 80, and a sensor position control program for carrying out sensor position control processing that will be described later, are respectively installed in the storage section 80C. Together with a correction amount computing program that is stored in a correction amount computing section 82 and is described later, these programs are examples of control programs of the image forming device relating to the present invention.

The image formation control sections 60K, 60C, 60M, 60Y of the image forming sections 32K, 32C, 32M, 32Y, the fixing control section 74, the page position prescribing mark detecting sensors 40, 42, and the sensor moving devices 44, 78 are connected to the main body control section 80. Further, the color offset correction mark detecting sensor 76 is connected to the main body control section 80 via the correction amount computing section 82. The correction amount computing section 82 is formed from an MCU (Micro-Control Unit) or the like, and the correction amount computing program, that is for realizing correction amount computing processing that is described later, is stored in advance in a non-volatile storage component that is built-in the correction amount computing section 82. Due to the MCU executing the correction amount computing program, the correction amount computing section 82, triggered by an instruction from the main body control section 80, acquires an output signal of the color offset correction mark detecting sensor 76, and carries out correction amount computing processing that computes and outputs correction amounts and the like for correcting color offset.

Figure 6:
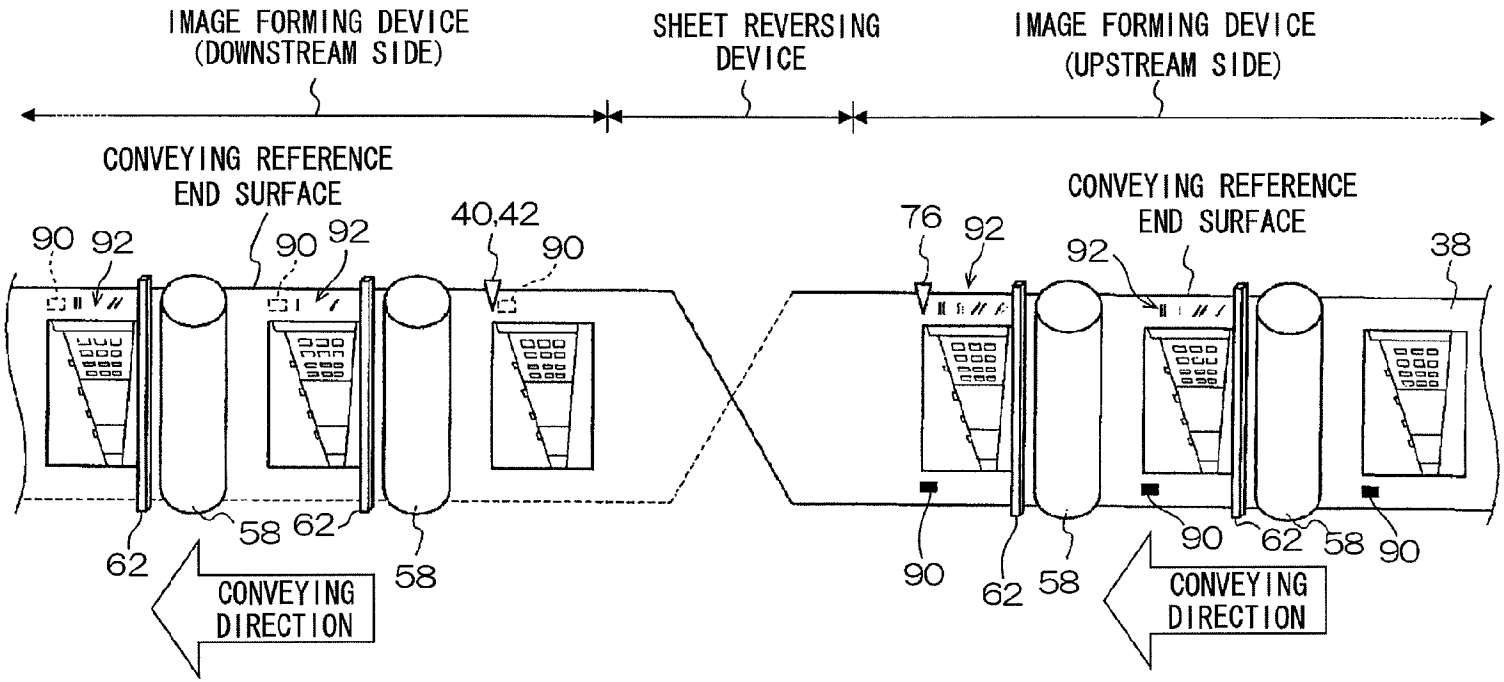
FIG. 6 is a schematic drawing showing the formation of images and marks onto both surfaces of a sheet in the image forming system.

Operation of the present exemplary embodiment is described next. As shown in FIG. 6, in the image forming system 10, images are formed in units of pages on one surface (the obverse) of the sheet 38 by the image forming device 14 at the upstream side, and, after the obverse and reverse of the sheet 38 are reversed by the sheet reversing device 16, images are formed in units of pages on the other surface (the reverse) of the sheet 38 by the image forming device 18 at the downstream side. However, when the formation position of an image onto the obverse of the sheet 38 and the formation position of an image onto the reverse of the sheet 38 are offset in the sheet conveying direction (the subscanning direction), there is the concern that portions of images will be lost or the like when the sheet 38 is cut into page units. The page position prescribing mark 90 is formed per page at one end portion of the sheet 38, in order to make the position along the sheet conveying direction of the image formed on the obverse of the sheet 38, and the position along the sheet conveying direction of the image formed on the reverse of the sheet 38, coincide per page.

Figure 16A:
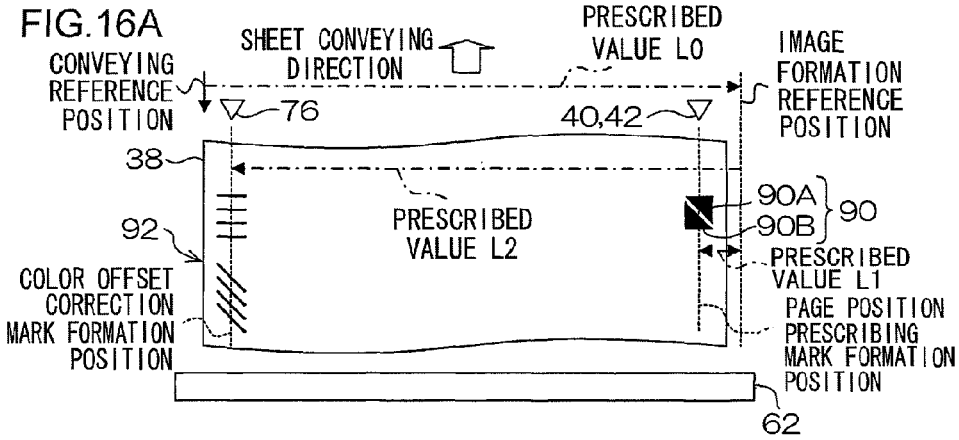
FIG. 16A is a schematic drawing for explaining, as a problem, fluctuations in a mark formation position when an image formation reference position is "distance from reference surface position=prescribed value" (sheet width=prescribed width)

Note that, as shown in FIG. 16A, the page position prescribing mark 90 that is used in the present exemplary embodiment is structured such that a pair of marks 90A, 90B, that are black and shaped as right triangles at each of which one of the two orthogonal sides is parallel to the transverse direction of the sheet 38 (the main scanning direction) and the other is directed parallel to the conveying direction of the sheet 38 (the subscanning direction), are disposed such that the inclined sides thereof face one another with an interval therebetween. However, the page position prescribing mark is not limited to the mark of the above-described structure, and a mark of another shape or structure, such as a rectangular mark or the like for example, may be used. Note that "orthogonal" and "parallel" used here also include structures in which the angular difference with respect to "orthogonal" or "parallel" falls within an allowable range that is set in advance.

Among the sheets 38 that are loaded in the sheet feeding device 12 of the image forming system 10, there are sheets at which the page position prescribing marks 90 are formed in advance in the manufacturing stage, and sheets at which the page position prescribing marks 90 are not formed. When the sheet 38 at which the page position prescribing marks 90 are formed in advance is fed from the sheet feeding device 12, the image forming device 14 at the upstream side detects, by either of the page position prescribing mark detecting sensors 40, 42, the page position prescribing marks 90 formed on the sheet 38 that is fed from the sheet feeding device 12. (Usually, the sheet 38 is fed from the sheet feeding device 12 with the surface on which the page position prescribing marks 90 are formed oriented so as to be the image formation surface (the orientation shown in FIG. 6), and therefore, the page position prescribing marks 90 are detected by the page position prescribing mark detecting sensor 40.) The images of the respective pages are respectively formed by the image forming sections 32K, 32C, 32M, 32Y at positions, that correspond to the detected page position prescribing marks 90, of the image formation surface (the obverse) of the sheet 38.

Further, the image forming device 18 at the downstream side detects, by either of the page position prescribing mark detecting sensors 40, 42, the page position prescribing marks 90 formed on the sheet 38 that is fed from the sheet reversing device 16. (Usually, accompanying the reversing of the obverse and the reverse of the sheet 38 by the sheet reversing device 16, the sheet 38 is fed from the sheet reversing device 16 with the surface on which the page position prescribing marks 90 are formed oriented so as to be the non-image formation surface (the orientation shown in FIG. 6), and therefore, the page position prescribing marks 90 are detected by the page position prescribing mark detecting sensor 42.) The images of the respective pages are respectively formed by the image forming sections 32K, 32C, 32M, 32Y at positions, that correspond to the detected page position prescribing marks 90, of the image formation surface (the reverse) of the sheet 38.

On the other hand, when the sheet 38 at which the page position prescribing marks 90 are not formed is fed from the sheet feeding device 12, the image forming device 14 at the upstream side forms the images of the respective pages, at preset intervals, by the image forming sections 32K, 32C, 32M, 32Y on the image formation surface (the obverse) of the sheet 38, and forms the page position prescribing marks 90 by the image forming section 32K at positions corresponding to the formed images, of one end portion side of the image formation surface (the obverse) of the sheet 38. Note that, at the image forming device 18 at the downstream side, as described above, the page position prescribing marks 90 formed on the sheet 38 are detected by the page position prescribing mark detecting sensor 42, and the images of the respective pages are respectively formed by the image forming sections 32K, 32C, 32M, 32Y at positions, that correspond to the detected page position prescribing marks 90, of the image formation surface (the reverse) of the sheet 38.

Further, at the image forming devices 14, 18, there are cases in which color offset (offset among the formation positions of the images of the respective colors of C, M, Y, K) arises in the images formed on the sheet 38 due to, for example, changes or the like in the relative positions of the image forming sections 32K, 32C, 32M, 32Y accompanying changes in the ambient temperature, the behavior of the sheet, or the like. In the present exemplary embodiment, with the object of suppressing color offset of the images, when the images of the respective pages are formed by the image forming sections 32K, 32C, 32M, 32Y of the image forming devices 14, 18, the marks 92 for color offset correction are respectively formed per page at, of the image formation surface of the sheet 38, the side opposite the side at which the page position prescribing marks 90 are formed (i.e., the marks 92 for color offset correction are formed at the conveying reference end surface side of the sheet 38).

Figure 7:
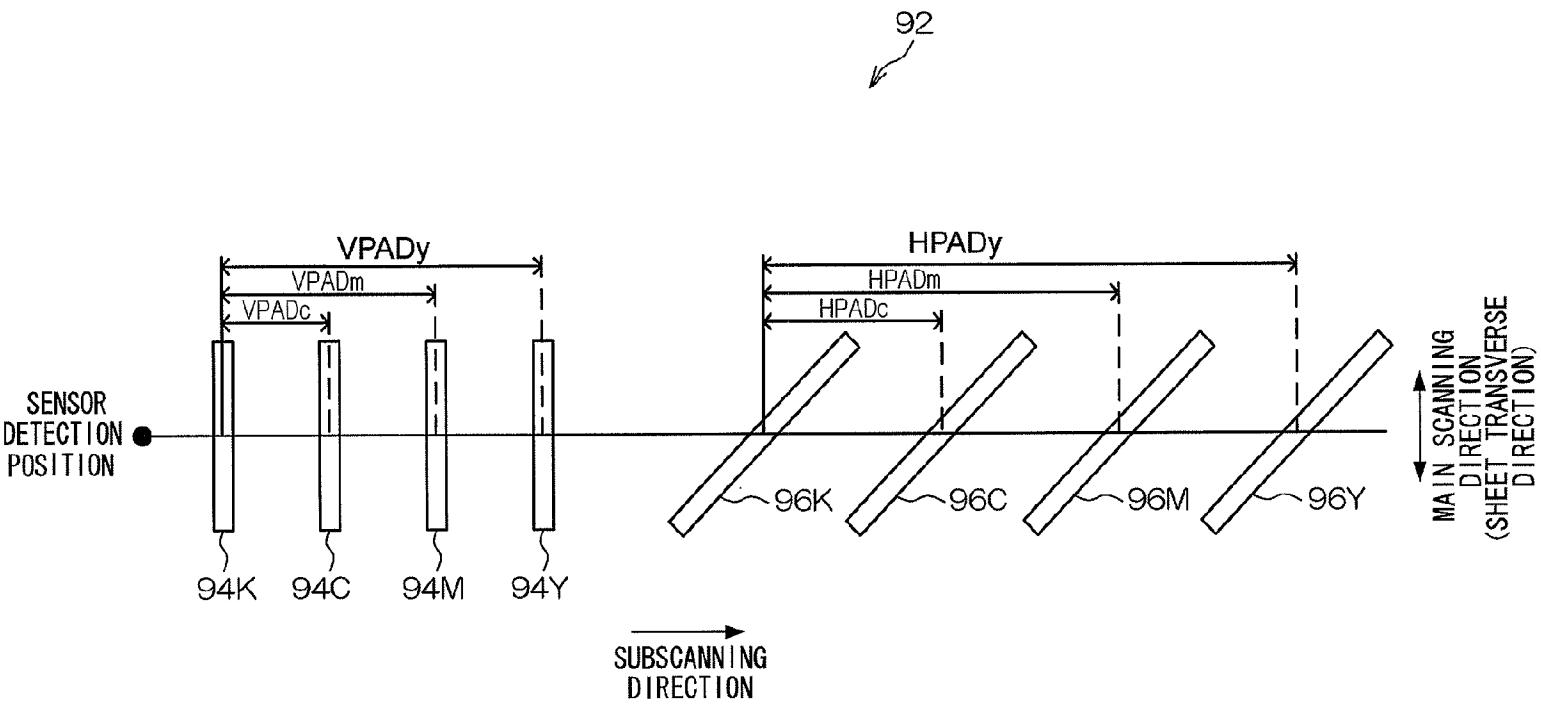
FIG. 7 is a plan view showing marks for color offset correction.

As shown in FIG. 7, the marks 92 for color offset correction that are used in the present exemplary embodiment are structured from plural first marks 94K, 94C, 94M, 94Y that are slender rectangles and whose length directions run along the transverse direction of the sheet 38 (the main scanning direction) and that are arrayed along the sheet conveying direction (the subscanning direction) at an interval, and plural second marks 96K, 96C, 96M, 96Y that are slender rectangles and that are inclined such that the length directions thereof form an angle θ (0°<θ<90°) with respect to the sheet conveying direction (the subscanning direction) and that are arrayed along the conveying direction of the sheet 38 (the subscanning direction) at an interval. Thereamong, the first mark 94K and the second mark 96K are marks of the color K, and are formed by the image forming section 32K. The first mark 94C and the second mark 96C are marks of the color C, and are formed by the image forming section 32C. The first mark 94M and the second mark 96M are marks of the color M, and are formed by the image forming section 32M. The first mark 94Y and the second mark 96Y are marks of the color Y, and are formed by the image forming section 32K.

Positions that are apart by distances VPADi (i=C, M, Y) in the sheet conveying direction with respect to the first mark 94K are the regular formation positions of the first marks 94C, 94M, 94Y. Positions that are apart by distances HPADi (i=C, M, Y) in the sheet conveying direction with respect to the second mark 96K are the regular formation positions of the second marks 96C, 96M, 96Y.

The correction amount computing section 82 computes color offset correction amounts for correcting color offset, on the basis of signals outputted from the color offset correction mark detecting sensor 76 that detects the marks 92 for color offset correction. Note that the processing described hereinafter is realized by the correction amount computing program being executed by the MCU of the correction amount computing section 82. Further, the computing of the color offset correction amounts that is described hereinafter is, together with the processings of steps 132, 134 that are described hereinafter, an example of the processing by the correction controlling component of the present invention.

Figure 8A:
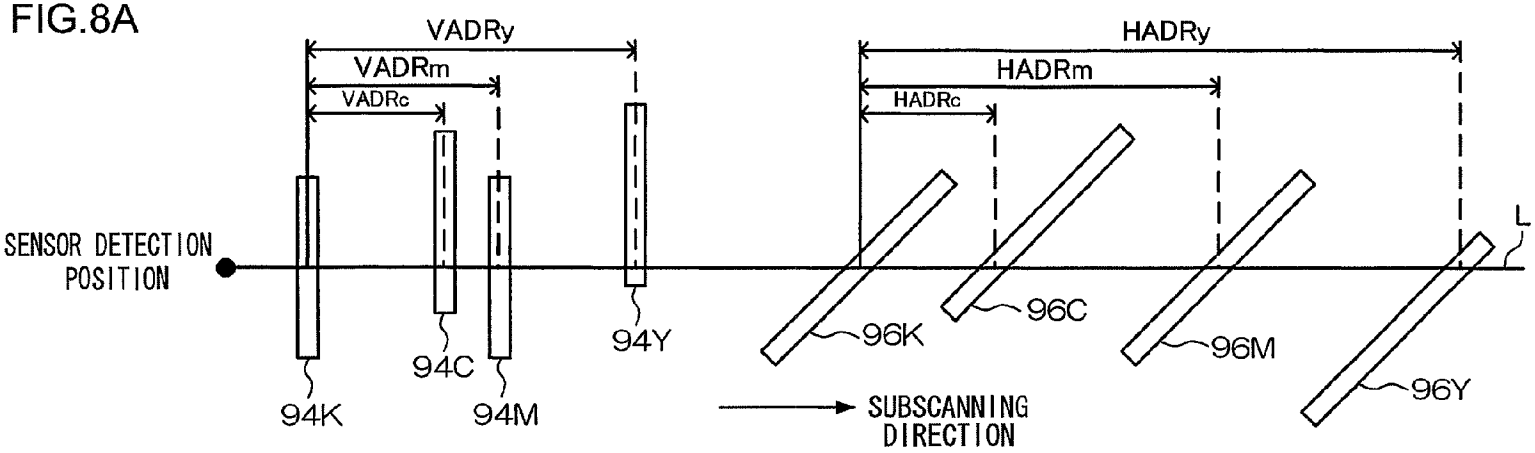
FIG. 8A is a plan view showing an example of a formed state of the marks for color offset correction.
Figure 8B:
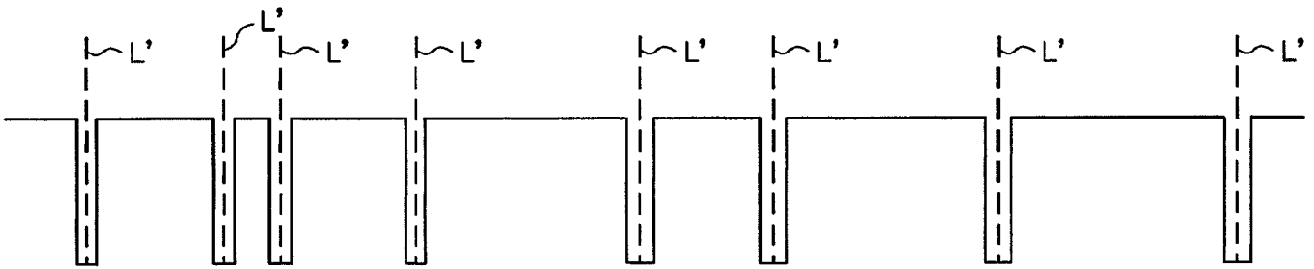
FIG. 8B is a waveform diagram showing an example of sensor output in the formed state shown in FIG. 8A.

Namely, when the marks 92 for color offset correction are in the formed state shown in FIG. 8A for example, the signal shown in FIG. 8B is outputted from the color offset correction mark detecting sensor 76. The correction amount computing section 82 computes, as the subscanning direction positions of the individual marks, the central positions (positions shown by dashed lines L' in FIG. 8B) of the signal change portions corresponding to the individual marks (the first marks 94K through 94Y and the second marks 96K through 96Y) that structure the marks 92 for color offset correction, among the output signal of the color offset correction mark detecting sensor 76.

Figure 9A:
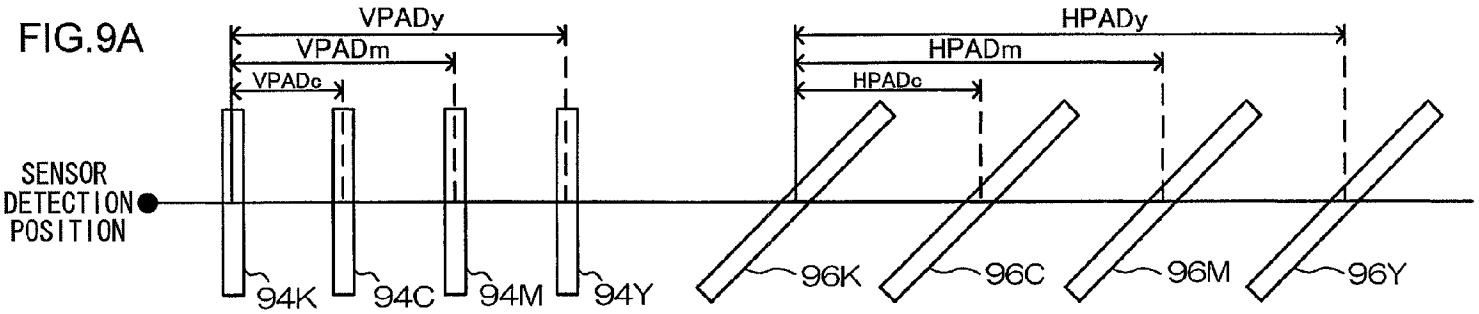
FIG. 9A is a plan view showing a formed state that is the reference of the marks for color offset correction.
Figure 9B:
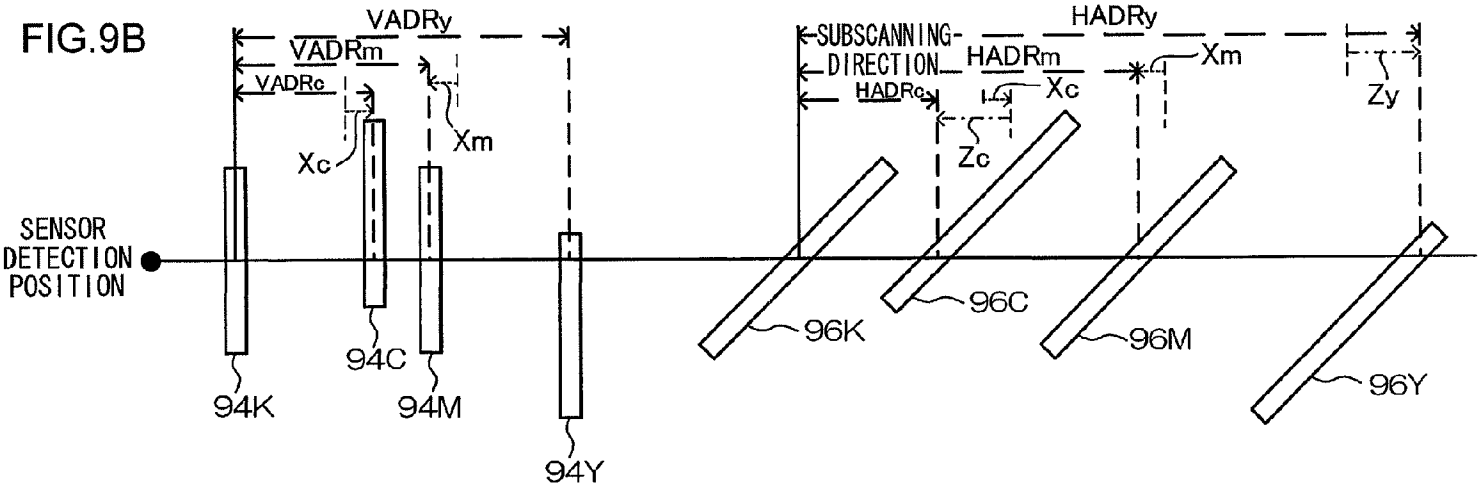
FIG. 9B is a plan view showing a state in which positional offset of the marks for color offset correction has arisen.

Next, intervals VADRi (i=C, M, Y) between the first mark 94K and the first marks 94C, 94M, 94Y are computed, and intervals HADRi (i=C, M, Y) between the second mark 96K and the second marks 96C, 96M, 96Y are computed (see FIG. 9B as well). Then, correction amounts VPOSi (i=C, M, Y) in the subscanning direction of the image formation positions of the respective colors of C, M, Y are computed in accordance with following formula (1).

$$VPOSi=P1(VADRi-VPADi) \quad (1)$$

Note that P1 in formula (1) is a coefficient for converting offset amount Xi (see FIG. 9B) in the subscanning direction of the actual formation position with respect to the regular formation position of the first mark 94, into correction amount VPOSi in the subscanning direction of the image formation position outputted to (the image formation control section 60C, 60M, 60Y of) the image forming section 32C, 32M, 32Y. Note that the sign of the correction amount VPOSi is positive when the detected interval VADRi is greater than the regular interval VPADi, and the sign of the correction amount VPOSi is negative when the detected interval VADRi is smaller than the regular interval VPADi.

Next, correction amounts HPOSi (i=C, M, Y) in the main scanning direction of the image formation positions of the respective colors of C, M, Y are computed in accordance with following formula (2).

$$HPOSi=P2(HADRi+(VADRi-VPADi)-HPADi) \quad (2)$$

Note that P2 in formula (2) is a coefficient for converting offset amount Zi (i=C, M, Y) in the subscanning direction that is due to offset in the main scanning direction of the formation position, into correction amount HPOSi in the main scanning direction of the image formation position outputted to (the image formation control section 60C, 60M, 60Y of) the image forming section 32C, 32M, 32Y. With regard to the first marks 94, the subscanning direction position changes only if the formation position is offset in the subscanning direction. On the other hand, with regard to the second marks 96, the subscanning direction position changes when the formation position is offset in the subscanning direction, and also when the formation position is offset in the main scanning direction. The offset amount Xi in the subscanning direction of each mark is known (=VADRi−VPADi). Therefore, the offset amount Zi (see FIG. 9B) that is due to offset in the main scanning direction of the formation position is determined, and the correction amount HPOSi in the main scanning direction of the image formation position is determined from above formula (2).

The correction amount VPOSi in the subscanning direction and the correction amount HPOSi (i=C, M, Y) in the main scanning direction of the image formation positions of the respective colors of C, M, Y that are computed by the correction amount computing section 82, are outputted, through the main body control section 80, to the image formation control sections 60C, 60M, 60Y of the image forming sections 32C, 32M, 32Y respectively. At the image formation control sections 60C, 60M, 60Y, the offset in the subscanning direction of the image formation position is corrected by changing, in accordance with the correction amount VPOSi in the subscanning direction, the time of the start of exposure of the image by the exposure head 62 of the exposure section. Further, the offset in the main scanning direction of the image formation position is corrected by changing, in accordance with the correction amount HPOSi in the main scanning direction, the formation position along the main scanning direction of the image exposed by the exposure head 62. Due thereto, color offset correction, that reduces the offset in the formation positions of the images of the respective colors of K, C, M, Y on the sheet 38, is realized.

Note that, at the exposure head 62 of the exposure section, an image formation reference position is provided at one end portion side of the array of light-emitting elements provided at the exposure head 62 (in the present exemplary embodiment, the image formation reference position is provided at the side opposite the conveying reference end surface of the sheet 38 that is conveyed on the sheet conveying path). The image formation control sections 60K through 60Y of the individual image forming sections 32K through 32Y hold the image formation position along the main scanning direction as a number of pixels corresponding to the distance between the image formation reference position and the end portion, at the image formation reference position side, of the image formation range along the main scanning direction. Then, when one line of the image is to be exposed by the exposure head 62 of the exposure section, the image formation control section 60K through 60Y generates a data string in which blank data (when the page position prescribing mark 90 is to be formed, data for forming the page position prescribing mark 90) of an amount corresponding to the aforementioned number of pixels is inserted in at the head of the image data of the one line, and supplies this data string to the exposure head 62. Due thereto, due to the individual light-emitting elements of the exposure head 62 being lit and extinguished in accordance with the supplied data string, the end portion, at the image formation reference position side, of the image formation range in the exposure of one line of the image is positioned at a position that is apart from the image formation reference position by a distance expressed by the aforementioned number of pixels. Changing the formation position, along the main scanning direction, of the image in accordance with the correction amount HPOSi in the main scanning direction is realized by increasing or decreasing the aforementioned number of pixels in accordance with the correction amount HPOSi in the main scanning direction.

At the image forming system 10 relating to the present exemplary embodiment, there are plural types of sheet widths of the sheets 38 that are to be loaded in the sheet feeding device 12. However, for each for these sheet widths, it is often the case that, due to manufacturing errors, the width of the sheet 38 that is actually loaded in the sheet feeding device 12 differs from the prescribed width that is determined by standards.

Figure 16B:
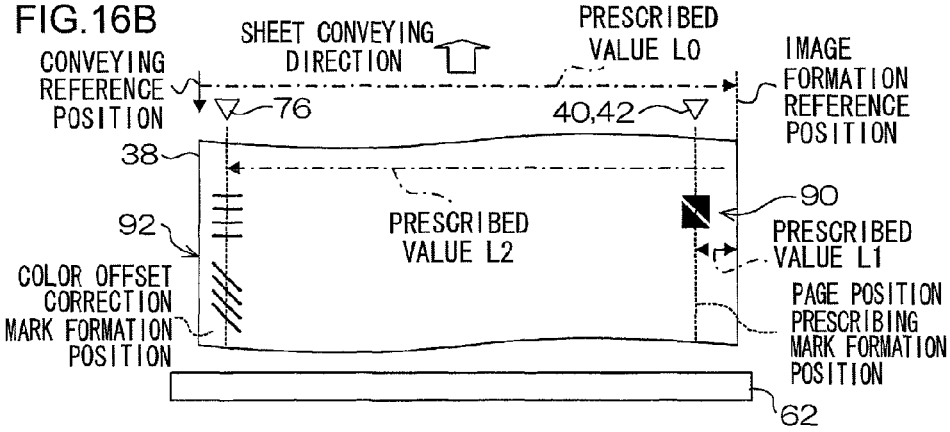
FIG. 16B is a schematic drawing for explaining, as a problem, fluctuations in the mark formation position when the image formation reference position is "distance from reference surface position=prescribed value" (sheet width>prescribed width)
Figure 16C:
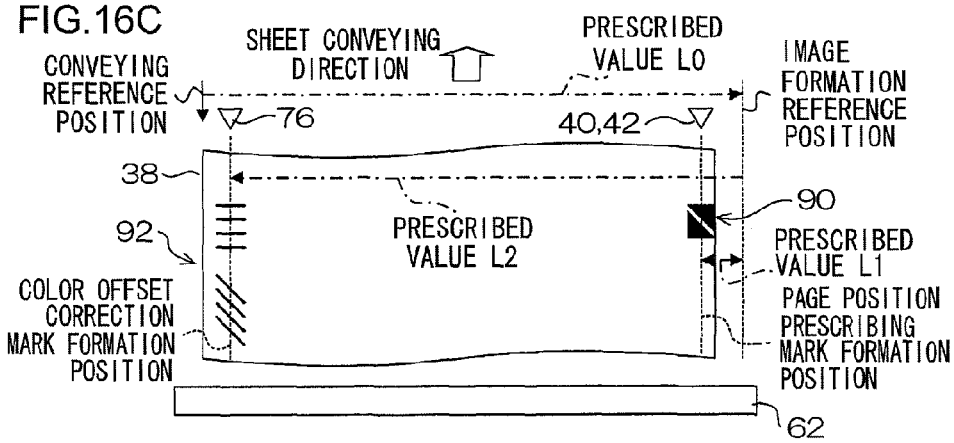
FIG. 16C is a schematic drawing for explaining, as a problem, fluctuations in the mark formation position when the image formation reference position is "distance from reference surface position=prescribed value" (sheet width<prescribed width)

Here, for example, as shown in FIG. 16, the image formation reference position at each of the image forming sections 32K through 32Y is a position that is apart, by a prescribed value L0 that corresponds to the prescribed width of the sheet 38, from the conveying reference position that corresponds to the position of the reference surface 56A of the conveying reference member 56 that is provided further upstream than the transfer position (the formation position), and that the formation position when the page position prescribing mark 90 is to be formed is a position that is apart from the image formation reference position by a prescribed value L1, and that the formation position of the marks 92 for color offset correction is a position that is apart from the image formation reference position by a prescribed value L2. However, in this case, if the actual sheet width of the sheet 38 is greater than the prescribed width, as shown in FIG. 16B, the formation position of the page position prescribing mark 90 moves in a direction of moving away from the end portion of the sheet 38. If the actual sheet width of the sheet 38 is smaller than the prescribed width, as shown in FIG. 16C, the formation position of the page position prescribing mark 90 moves in a direction of approaching the end portion of the sheet 38.

Figure 17A:
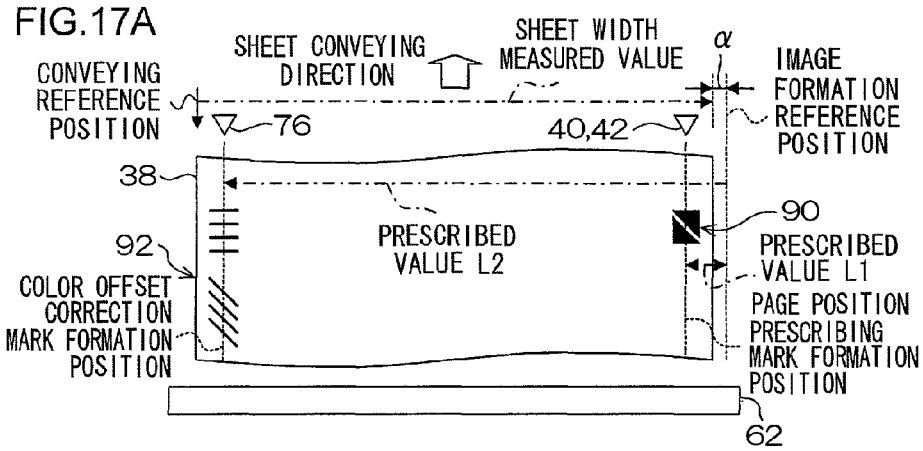
FIG. 17A is a schematic drawing for explaining, as a problem, fluctuations in the mark formation position when the image formation reference position is "distance from reference surface position=sheet width measured value+$\alpha$" (sheet width=prescribed width)
Figure 17B:
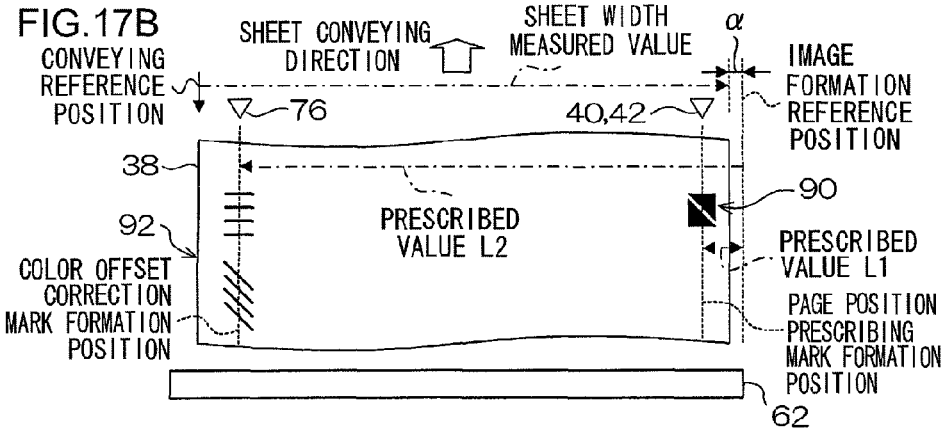
FIG. 17B is a schematic drawing for explaining, as a problem, fluctuations in the mark formation position when the image formation reference position is "distance from reference surface position=sheet width measured value+α" (sheet width>prescribed width)
Figure 17C:
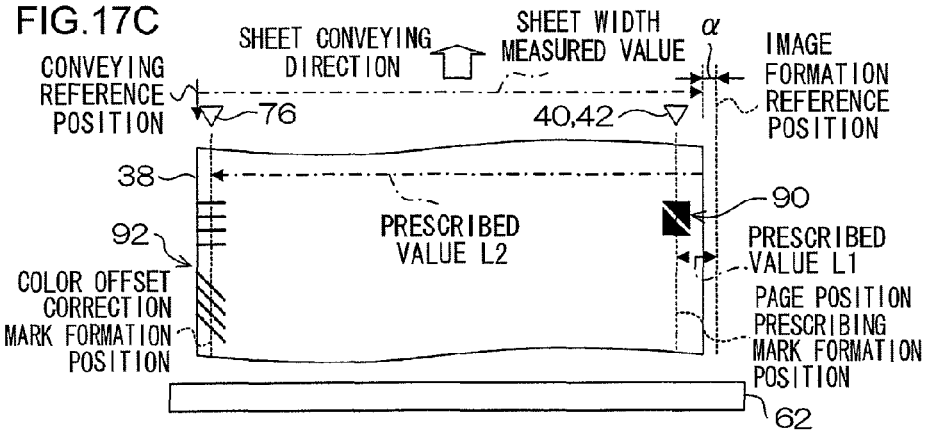
FIG. 17C is a schematic drawing for explaining, as a problem, fluctuations in the mark formation position when the image formation reference position is "distance from reference surface position=sheet width measured value+α" (sheet width<prescribed width).

Further, for example, as shown in FIG. 17, the actual sheet width of the sheet 38 is measured, and the image formation reference position at each of the image forming sections 32K through 32Y is a position that is apart from the conveying reference position by a value obtained by adding a prescribed value $\alpha$ to the measured value of the sheet width of the sheet 38, and that the formation position when the page position prescribing mark 90 is to be formed is a position that is apart from the image formation reference position by the prescribed value L1, and that the formation position of the marks 92 for color offset correction is a position that is apart from the image formation reference position by the prescribed value L2. However, in this case, if the actual sheet width of the sheet 38 is greater than the prescribed width, as shown in FIG. 17B, the formation position of the marks 92 for color offset correction moves in a direction of moving away from the end portion of the sheet 38. If the actual sheet width of the sheet 38 is smaller than the prescribed width, as shown in FIG. 17C, the formation position of the marks 92 for color offset correction moves in a direction of approaching the end portion of the sheet 38.

Figure 10:
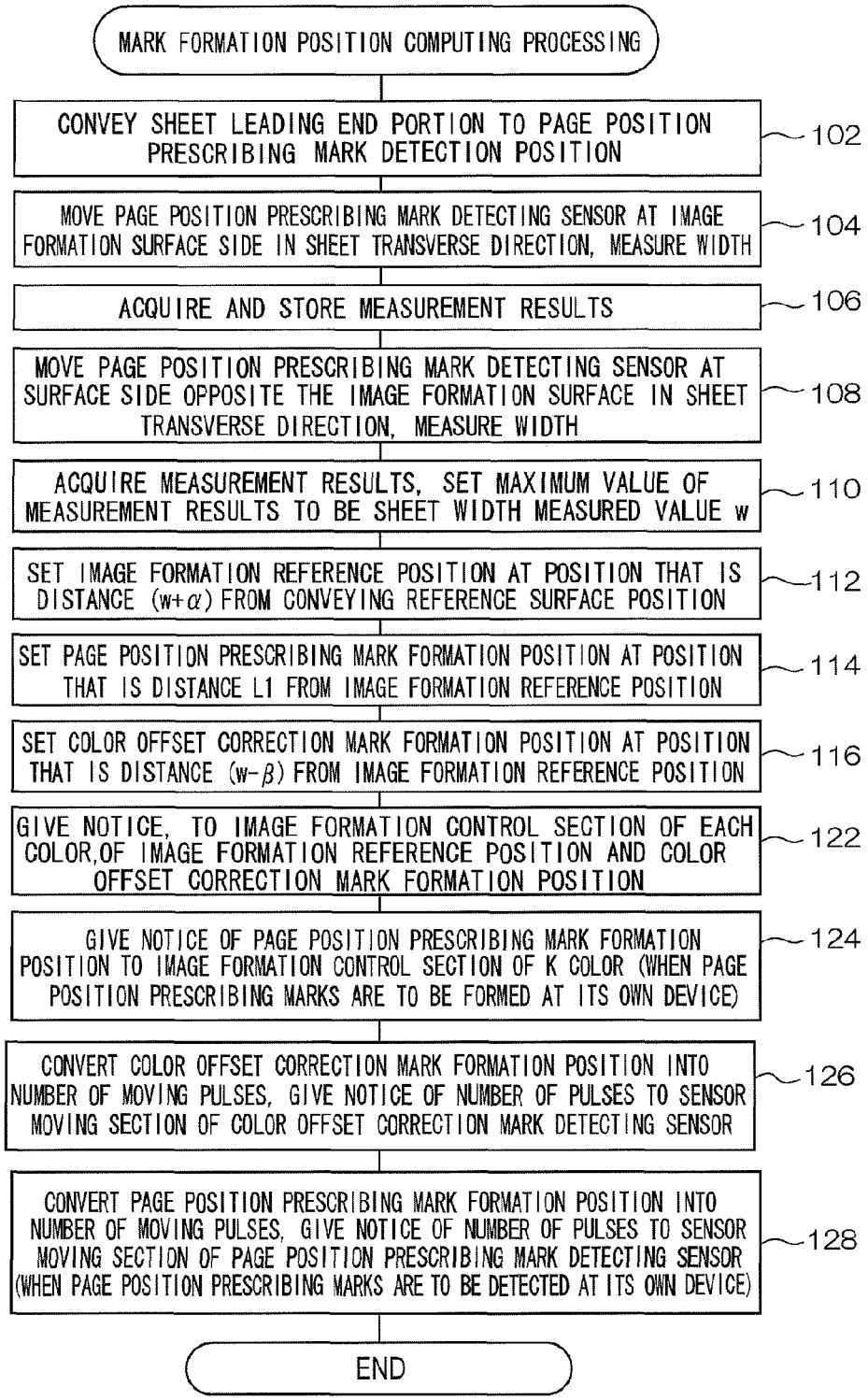
FIG. 10 is a flowchart showing the contents of mark formation position computing processing.

Therefore, at the image forming devices 14, 18 of the image forming system 10 relating to the present exemplary embodiment, due to a mark formation position computing program being executed by the respective CPUs 80A of the main body control sections 80 when the power of the image forming system 10 is turned on or when the sheet 38 that is loaded in the sheet feeding section 12 is replaced, the mark formation position computing processing shown in FIG. 10 is carried out by the respective main body control sections 80.

In the mark formation position computing processing, first, in step 102, the sheet 38 that is fed from the device at the upstream side of its own device (from the sheet feeding device 12 if its own device is the image forming device 14, and from the sheet reversing device 16 if its own device is the image forming device 18) is conveyed by the conveying rollers 36A, 36B of the sheet feeding section 30 until the leading end portion of the sheet 38 arrives at the detection position of the page position prescribing mark 90 by the page position prescribing mark detecting sensors 40, 42. In next step 104, the page position prescribing mark detecting sensor 40 that is disposed at the image formation surface side of its own device is moved in the sheet transverse direction by the sensor moving device 44, and the distance that the page position prescribing mark detecting sensor 40 moves during the interval, in which the light reflected from the sheet 38 is detected by the photoelectric converting element of the page position prescribing mark detecting sensor 40, is measured as the width of the sheet 38. Then, in step 106, the measurement results of the width of the sheet 38 by the page position prescribing mark detecting sensor 40 are acquired, and the acquired measurement results of the width are stored in the memory 80B.

In next step 108, the page position prescribing mark detecting sensor 42, that is disposed at the opposite surface side of the image formation surface side of its own device, is moved in the sheet transverse direction by the sensor moving device 44, and the width of the sheet 38 is measured by the page position prescribing mark detecting sensor 42. In step 110, the measurement results of the width of the sheet 38 by the page position prescribing mark detecting sensor 42 are acquired, and the acquired measurement results are compared with the measurement results of the width of the sheet 38 by the page position prescribing mark detecting sensor 40 that are stored in the memory 80B, and the greater of the values is set to be sheet width measured value w. Note that step 110, together with previous step 106, is an example of the processing by the acquiring component of the present invention at the image forming device 14 at the upstream side.

Figure 11A:
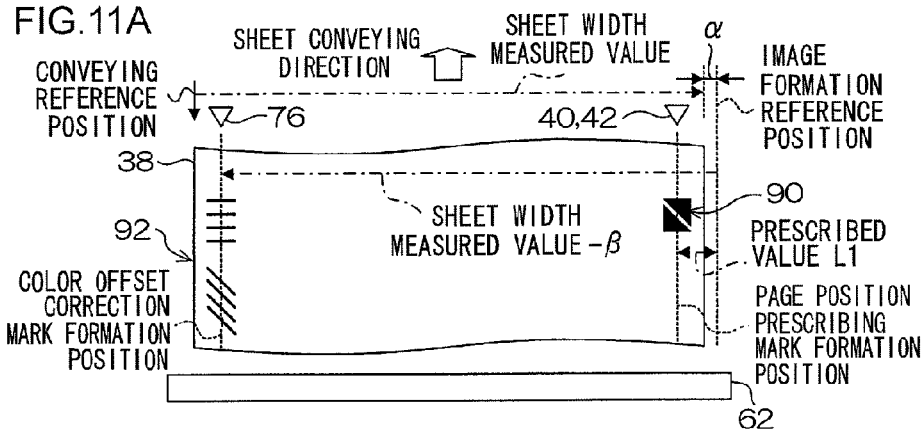
FIG. 11A is a schematic drawing for explaining operation of the mark formation position computing processing (sheet width=prescribed width)

In step 112, on the basis of the sheet width measured value w that was set in step 110, the image formation reference position at the individual image forming sections 32K through 32Y is set at a position that is apart, along the sheet transverse direction and from the conveying reference position corresponding to the position of the reference surface 56A of the conveying reference member 56, by a distance that corresponds to a value obtained by adding the preset value $\alpha$ to the sheet width measured value w (see FIG. 11A). Further, in step 114, the formation position of the page position prescribing mark 90 along the sheet transverse direction is set at a position that is apart, by the preset distance L1 and along the sheet transverse direction, from the image formation reference position set in step 112 (see FIG. 11A). Moreover, in step 116, the formation position of the marks 92 for color offset correction along the sheet transverse direction is set at a position that is apart, along the sheet transverse direction and from the image formation reference position set in step 112, by a distance that corresponds to a value obtained by subtracting a preset value from the sheet width measured value w (see FIG. 11A).

Figure 11B:
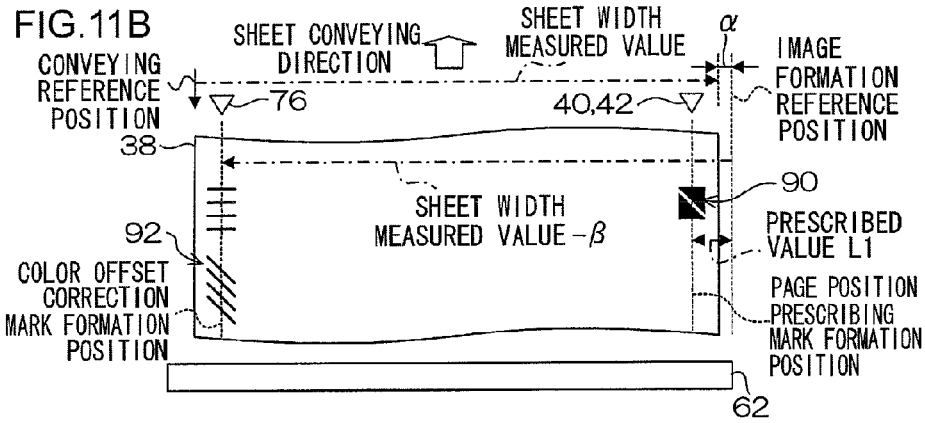
FIG. 11B is a schematic drawing for explaining operation of the mark formation position computing processing (sheet width>prescribed width)
Figure 11C:
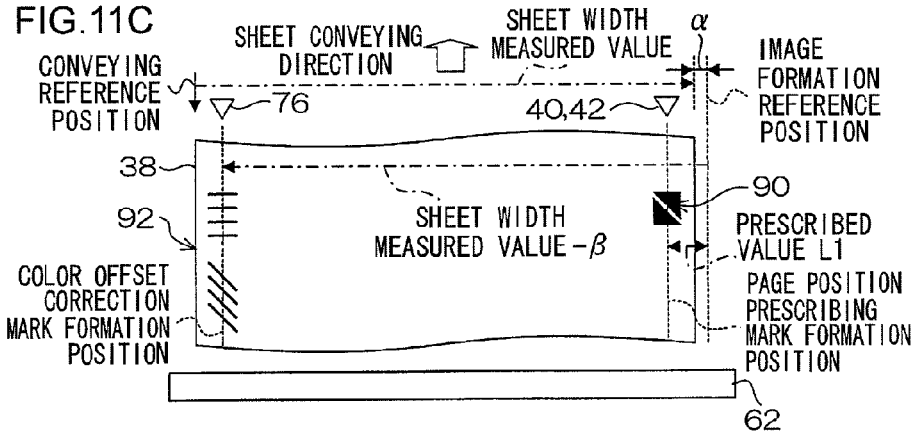
FIG. 11C is a schematic drawing for explaining operation of the mark formation position computing processing (sheet width<prescribed width)

In next step 122, the image formation reference position and the formation position of the marks 92 for color offset correction, that were obtained by the above-described processings, are notified respectively to the image formation control sections 60K through 60Y of the respective colors. Due thereto, as shown in FIG. 11A through FIG. 11C, when formation of the image including the marks 92 for color offset correction is carried out at the image forming sections 32K through 32Y, the formation position of the marks 92 for color offset correction on the sheet 38 fluctuating in accordance with the actual width of the sheet 38 is suppressed. Further, also the formation position of the image on the sheet 38 fluctuating in accordance with the actual width of the sheet 38 is suppressed. Note that step 122 is an example of the processing by the formation control component of the present invention.

Further, in step 124, when the page position prescribing mark 90 is to be formed at its own device (i.e., when its own device is the image forming device 14 at the upstream side and the sheet 38, on which the page position prescribing marks 90 are not formed in advance, is supplied from the sheet feeding device 12), the page position prescribing mark formation position obtained by the above-described processing is notified to the image formation control section 60K of K color. Due thereto, as shown in FIG. 11A through FIG. 11C, when formation of the image including the page position prescribing mark 90 is carried out at the image forming section 32K, also the formation position of the page position prescribing mark 90 on the sheet 38 fluctuating in accordance with the actual width of the sheet 38 is suppressed.

In step 126, the deviation between the actual position of the color offset correction mark detecting sensor 76, and the formation position of the marks for color offset correction that was obtained by the above-described processing, is computed, and the computed deviation is converted into a number of pulses for moving the position of the color offset correction mark detecting sensor 76 by the deviation, and the sensor moving device 78 of the color offset correction mark detecting sensor 76 is notified of the number of pulses. At the sensor moving device 78, by supplying the sensor driving motor with driving pulses of the number of pulses that was notified, the position of the color offset correction mark detecting sensor 76 is moved by an amount corresponding to the deviation. Due thereto, the position of the color offset correction mark detecting sensor 76 is moved to the position at which the marks 92 for color offset correction are formed, and more specifically, to the regular sensor detection position shown in FIG. 7 through FIG. 9.

When the page position prescribing marks 90 are not to be detected at its own device, the mark formation processing is finished by the above-described processing. However, when the page position prescribing marks 90 are to be detected at its own device (i.e., when its own device is the image forming device 18 at the downstream side, and when its own device is the image forming device 14 at the upstream side and the sheet 38, on which the page position prescribing marks 90 are formed in advance, is supplied from the sheet feeding device 12), in next step 128, the deviations between the actual positions of the page position prescribing mark detecting sensors 40, 42, and the formation position of the page position prescribing mark that was obtained by the above-described processing, are respectively computed, and the computed deviations are respectively converted into numbers of pulses for moving the positions of the page position prescribing mark detecting sensors 40, 42 by the deviations, and the sensor moving devices 44 of the page position prescribing mark detecting sensors 40, 42 are notified of the numbers of pulses.

At the sensor moving devices 44, by supplying the sensor driving motors with driving pulses of the numbers of pulses that were notified, the positions of the page position prescribing mark detecting sensors 40, 42 are respectively moved by amounts corresponding to the deviations. Due thereto, the positions of the page position prescribing mark detecting sensors 40, 42 are moved to the position at which the page position prescribing mark 90 is formed.

Figure 12:
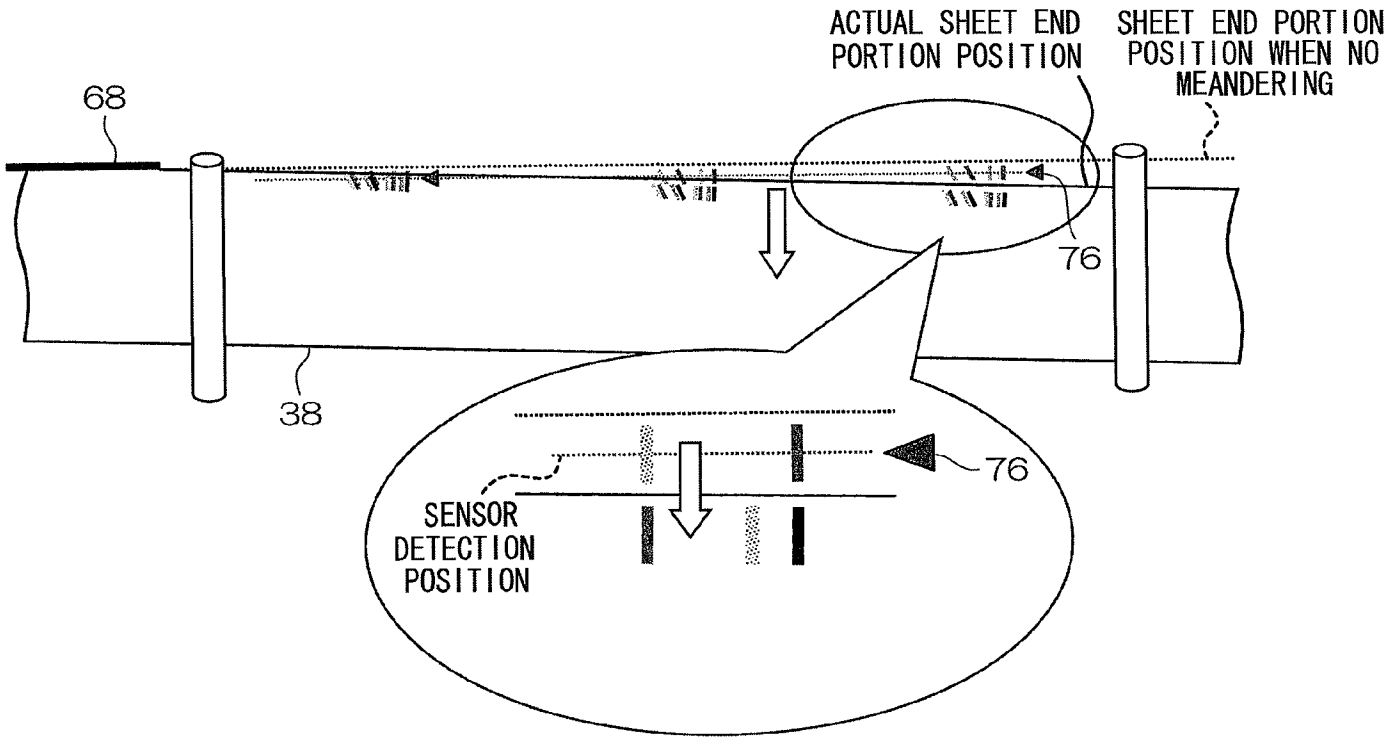
FIG. 12 is a schematic drawing for explaining changes in relative positions between the marks for color offset correction and a detection position by a color offset correction mark detecting sensor, that are due to meandering of a sheet.

Due to the above-described mark formation position computing processing, the color offset correction mark detecting sensor 76 is positioned at the regular sensor detection position shown in FIG. 7 through FIG. 9. However, in the image forming system 10 relating to the present exemplary embodiment, because the position at which the conveying reference member 56 is provided and the position at which the color offset correction mark detecting sensor 76 is provided are set apart relatively greatly, there are cases in which, due to meandering of the sheet 38 or the like, the position of the sheet 38, at the position at which the color offset correction mark detecting sensor 76 is provided, fluctuates in the sheet transverse direction. If the position of the sheet 38 fluctuates in the sheet transverse direction, as shown in FIG. 12, the relative positions, along the sheet transverse direction, of the color offset correction mark detecting sensor 76 and the marks 92 for color offset correction fluctuate. Therefore, if the relative change amount along the sheet transverse direction becomes excessively large (as shown by the enlarged view in FIG. 12), a case may arise in which the marks 92 for color offset correction cannot be detected by the color offset correction mark detecting sensor 76, and punch holes formed in the end portion of the sheet 38, or the like, are erroneously detected as the marks 92 for color offset correction.

Figure 13:
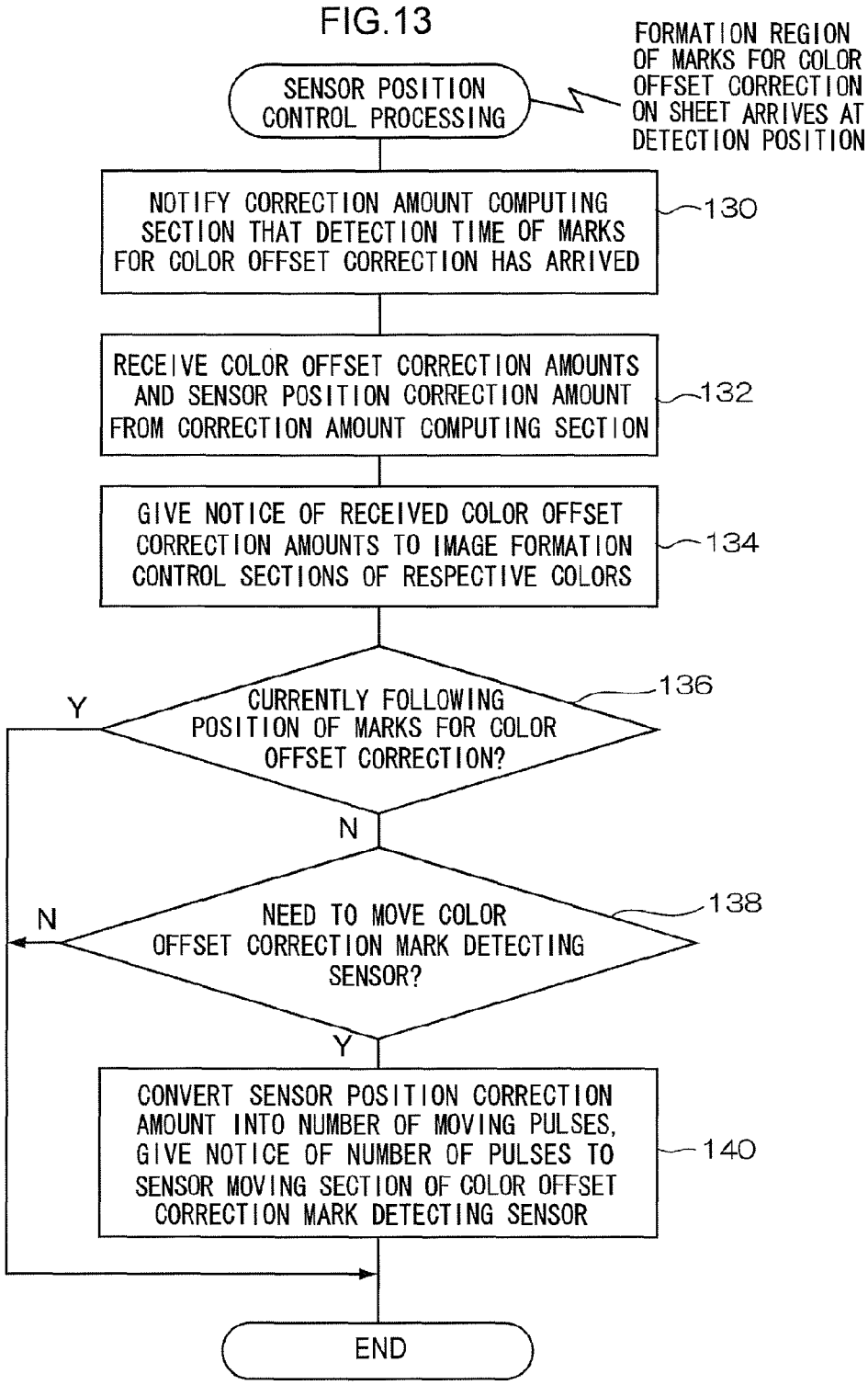
FIG. 13 is a flowchart showing the contents of sensor position control processing.

Thus, at the image forming devices 14, 18 of the image forming system 10 relating to the present exemplary embodiment, each time the region at which the marks 92 for color offset correction are formed on the sheet 38 arrives at the position at which the color offset correction mark detecting sensor 76 is provided (the position of detecting the marks 92 for color offset correction), a sensor position control program is executed by the CPUs 80A of the main body control sections 80 respectively, and the sensor position control processing shown in FIG. 13 is executed by the main body control sections 80 respectively.

In step 130, the correction amount computing section 82 is notified that the time to detect the marks 92 for color offset correction has arrived. Due thereto, at the correction amount computing section 82, on the basis of the signal outputted from the color offset correction mark detecting sensor 76 that detected the marks 92 for color offset correction, the color offset correction amounts (the correction amounts VPOSi in the subscanning direction of the image formation positions of the respective colors of C, M, Y and the correction amounts HPOSi (i=C, M, Y) in the main scanning direction) are computed as described above, and, in addition thereto, a sensor position correction amount, that is for correcting the offset along the sheet transverse direction (the main scanning direction) of the detection position of the color offset correction mark detecting sensor 76 with respect to the positions of the marks 94K, 96K that are formed by the image forming section 32K among the marks 92 for color offset correction, is also computed. Note that the computing of the sensor position correction amount, that is described hereinafter, also is realized by a correction amount computing program being executed by the MCU of the correction amount computing section 82.

Figure 14:
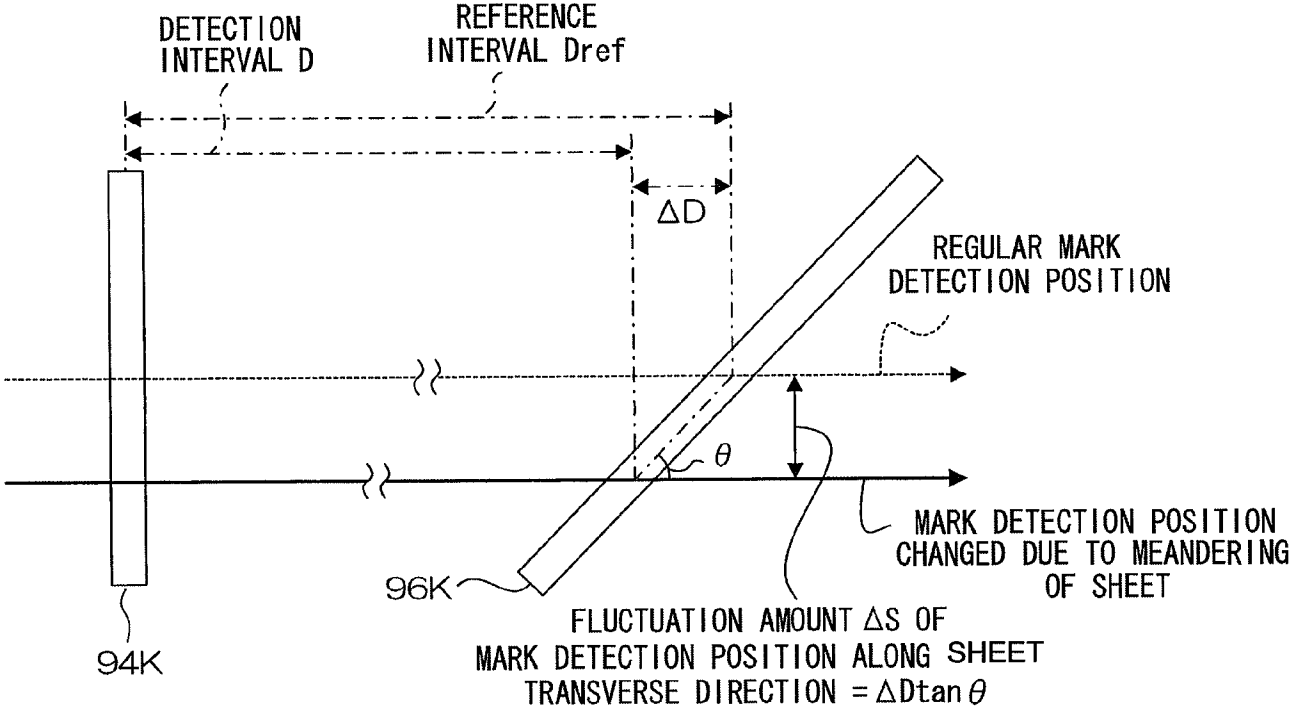
FIG. 14 is an explanatory drawing for explaining computing of a sensor position correction amount by a correction amount computing section.

Concretely, as shown in FIG. 14, with regard to the marks 94K, 96K that are formed by the image forming section 32K, the length direction of the second mark 96K is inclined with respect to the length direction of the first mark 94K. Therefore, when, due to meandering of the sheet 38, the detection position of the color offset correction mark detecting sensor 76 changes in the sheet transverse direction (the main scanning direction) with respect to the regular detection position, an interval D between the first mark 94K and the second mark 96K detected by the color offset correction mark detecting sensor 76 also changes.

Therefore, the correction amount computing section 82 stores, in advance and in a non-volatile memory and as a reference interval Dref (see FIG. 14), the interval D between the first mark 94K and the second mark 96K at the regular detection position of the color offset correction mark detecting sensor 76. When the time for detecting the marks 92 for color offset correction arrives, the correction amount computing section 82 computes the interval D between the first mark 94K and the second mark 96K on the basis of the signal outputted from the color offset correction mark detecting sensor 76, and, in accordance with following formula (3), computes change amount ΔS of the current detection position with respect to the regular detection position of the color offset correction mark detecting sensor 76.

$$\Delta S=(D\mathrm{ref}-D)\tan\theta \tag{3}$$

The θ in formula (3) is the angle formed by the sheet conveying direction (the subscanning direction) and the length direction of the second mark 96K. Further, the correction amount computing section 82 outputs the change amount ΔS of the detection position of the color offset correction mark detecting sensor 76 that was determined by formula (3), as a sensor position correction amount to the main body control section 80 together with the color offset correction amounts.

Note that the above-described computing of the sensor position correction amount that is carried out at the correction amount computing section 82 is an example of processing by the sensing component of the present invention. Further, at the marks 92 for color offset correction, the interval (see FIG. 14) between the first mark 94K and the second mark 96K is an example of the "portion whose length along the first direction varies continuously along the second direction" at the index relating to the present invention. Further, the above-described computing of the sensor position correction amount may be carried out at the main body control section 80 instead of the correction amount computing section 82.

At the main body control section 80, the color offset correction amounts and the sensor position correction amount that were outputted from the correction amount computing section 82 are acquired in step 132. In next step 134, the image formation control sections 60K through 60Y are notified of the color offset correction amounts acquired from the correction amount computing section 82 (the correction amounts VPOSi in the subscanning direction of the image formation positions of the respective colors of C, M, Y and the correction amounts HPOSi (i=C, M, Y) in the main scanning direction), and the above-described color offset correction is carried out. Note that, instead of merely notifying the image formation control sections 60K through 60Y of the color offset correction amounts acquired from the correction amount computing section 82, the image formation control sections 60K through 60Y may be notified after the color offset correction amounts are corrected in accordance with the sensor position correction amount (the change amount ΔS of the detection position of the color offset correction mark detecting sensor 76). Further, the correction amount computing section 82 may be structured such that color offset correction amounts, that are corrected in accordance with the sensor position correction amount, are outputted from the correction amount computing section 82.

The processings from next step 136 on are an example of the processing by the movement control component of the present invention. First, in step 136, it is judged whether or not the sensor moving device 78 is in the midst of moving the color offset correction mark detecting sensor 76 in order to make the detection position of the color offset correction mark detecting sensor 76 follow the change in position of the marks 94K, 96K. If the judgment is affirmative, the sensor position control processing ends. Further, if the judgment in step 136 is negative, the routine moves on to step 138 where the deviation between the current position of the color offset correction mark detecting sensor 76, and a movement target position of the color offset correction mark detecting sensor 76 that is expressed by the sensor position correction amount acquired from the correction amount computing section 82, is computed (i.e., the movement amount of the color offset correction mark detecting sensor 76 is computed), and, on the basis of whether or not the computed deviation (movement amount) is greater than or equal to a preset threshold value, it is judged whether or not the color offset correction mark detecting sensor 76 must be moved.

If the computed deviation (movement amount) is less than the threshold value, the judgment in step 138 is negative, and the sensor position control processing ends. Further, if the computed deviation (movement amount) is greater than or equal to the threshold value, the judgment in step 138 is affirmative, and the routine moves on to step 140 where the computed deviation (movement amount) is converted into a number of pulses for moving the position of the color offset correction mark detecting sensor 76 by the deviation (movement amount), and the sensor moving device 78 of the color offset correction mark detecting sensor 76 is notified of the number of pulses. At the sensor moving device 78, by supplying driving pulses of the notified number of pulses to the sensor moving motor, the position of the color offset correction mark detecting sensor 76 is moved by an amount corresponding to the deviation (the movement amount) in the sheet transverse direction (the main scanning direction). Due thereto, the color offset correction mark detecting sensor 76 is moved to the regular detection position.

The sensor position control processing shown in FIG. 13 is executed each time the region, at which the marks 92 for color offset correction are formed on the sheet 38, arrives at the detection position of the marks 92 for color offset correction. Therefore, even if the position of the marks 92 for color offset correction (the positions of the marks 94K, 96K) at the detection position of the marks 92 for color offset correction changes accompanying changes in the conveyed state, including meandering, of the sheet 38, each time a change in position of the marks 94K, 96K is sensed, the color offset correction mark detecting sensor 76 is moved so as to follow the changes in the position of the marks 94K, 96K.

Note that, if the region at which the marks 92 for color offset correction are formed on the sheet 38 completely comes out of the detection range of the color offset correction mark detecting sensor 76 along the sheet transverse direction, the above-described color offset correction and the above-described sensor position control processing cannot be executed. However, in the present exemplary embodiment, by making the formation position of the marks 92 for color offset correction along the sheet transverse direction be a position that is separated, along the sheet transverse direction from the image formation reference position, by a distance corresponding to the sheet width measured value w (a distance corresponding to a value obtained by subtracting the preset value β from the sheet width measured value w), the formation position of the marks 92 for color offset correction on the sheet 38 fluctuating in accordance with the actual width of the sheet 38 is suppressed. Therefore, the amount of fluctuation in the position of the sheet 38 along the sheet transverse direction when the leading end of the sheet 38 or the region near the leading end passes the detection position of the marks 92 for color offset correction is relatively small, and, combined therewith, the marks 92 for color offset correction that are formed in a vicinity of the leading end portion of the sheet 38 completely coming out of the detection range of the color offset correction mark detecting sensor 76 is prevented.

Further, after the marks 92 for color offset correction that are formed in a vicinity of the leading end portion of the sheet 38 are detected by the color offset correction mark detecting sensor 76, the color offset correction mark detecting sensor 76 is moved so as to follow the positional changes of the marks 92 for color offset correction, due to the above-described sensor position control processing. Therefore, even if the amount of fluctuation in the position of the sheet 38 along the sheet transverse direction at the time of passing the detection position of the marks 92 for color offset correction becomes large due to meandering of the sheet 38 or the like, the formation region of the marks 92 for color offset correction on the sheet 38 is prevented from coming completely out of the range of detection of the color offset correction mark detecting sensor 76 along the sheet transverse direction.

Note that the above describes an aspect in which, among the both transverse direction end portions of the sheet 38, the end portion at the side at which the marks 92 for color offset correction are formed (the end portion at the side opposite the side at which the image formation reference position is positioned and the page position prescribing marks 90 are formed) collides against the reference surface 56A of the conveying reference member 56 that serves as the collision member, and the image formation reference position is set at a position that is separated in the sheet transverse direction by the distance "sheet width measured value w+preset value α" from the conveying reference position that corresponds to the position of a reference surface 68A, and the formation position of the page position prescribing mark 90 is set at a position that is apart in the sheet transverse direction from the image formation reference position by the preset distance L1, and the formation position of the marks 92 for color offset correction is set at a position that is apart in the sheet transverse direction from the image formation reference position by the distance "sheet width measured value w−preset value β". However, the present invention is not limited to the same, and, among the both transverse direction end portions of the sheet 38, the end portion that is at the side where the image forming reference position is positioned and the page position prescribing mark 90 is formed (the end portion at the opposite side of the side at which the marks 92 for color offset correction are formed) may be made to abut the reference surface 56A (the abutment member) of the conveying reference member 56. In this case, the image formation reference position is set at a position that is apart in the sheet transverse direction by a preset first distance from the conveying reference position that corresponds to the position of the reference surface 68A, and the formation position of the page position prescribing mark 90 is set at a position that is apart in the sheet transverse direction from the image formation reference position by a preset second distance, and the formation position of the marks 92 for color offset correction is set at a position that is apart in the sheet transverse direction from the image formation reference position by a distance corresponding to the sheet width measured value w.

Figure 15:
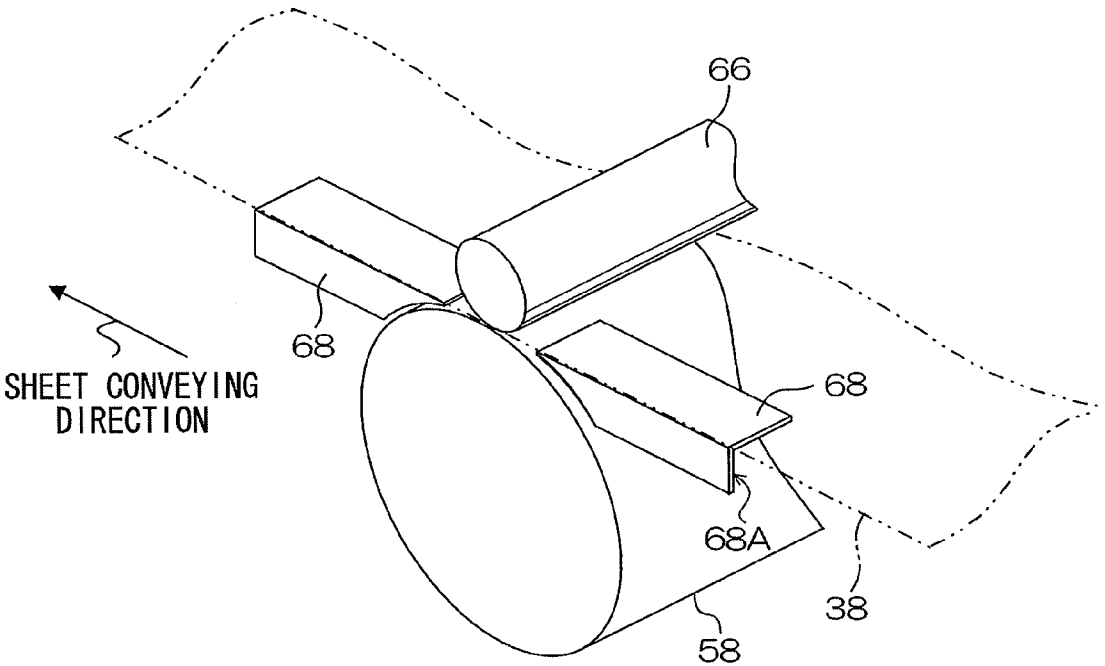
FIG. 15 is a perspective view showing conveying reference members provided at a transfer position.

Further, an aspect is described above in which the conveying reference member 56 that serves as the collision member is provided further toward the upstream side in the conveying direction of the sheet 38 than the transfer position (formation position). However, the present invention is not limited to the same, and as shown in FIG. 15 for example, the collision member may be provided at the transfer position (formation position). In the aspect shown in FIG. 15, at the transfer position of each of the image forming sections 32K, 32C, 32M, 32Y, at the sheet conveying path in front of and behind the transfer position of the transfer portion where the peripheral surface of the transfer roller 66 contacts the peripheral surface of the photoreceptor drum 58, conveying reference members 68, at which are formed reference surfaces 68A that are approximately parallel to the sheet conveying direction and approximately orthogonal to the transverse direction of the sheet 38, are respectively provided at the side portion, at the conveying reference end surface side, of the sheet 38 that is conveyed on the sheet conveying path. At the transfer position of each of the image forming sections 32K, 32C, 32M, 32Y, due to the conveying reference end surface of the sheet 38 that is conveyed on the sheet conveying path colliding against the reference surfaces 68A of the conveying reference members 68, the sheet 38 is conveyed while the state, in which the position of the conveying reference end surface coincides with the position of the reference surfaces 68A, is maintained.

In this case, the position of the reference surfaces 68A of the conveying reference members 68 is the conveying reference position, and, for example, if this conveying reference position is at the side at which the marks 92 for color offset correction are formed (the side opposite the side at which the image formation reference position is positioned and the page position prescribing mark 90 is formed), it suffices to set the image formation reference position to be a position that is apart in the sheet transverse direction from the conveying reference position by the distance "sheet width measured value w+preset value α", and to set the formation position of the page position prescribing mark 90 at a position that is apart in the sheet transverse direction from the image formation reference position by the preset distance L1, and to set the formation position of the marks 92 for color offset correction at a position that is apart in the sheet transverse direction from the image formation reference position by the distance "sheet width measured value w−preset value β".

As described above, when the conveying reference members 68 (the collision member) are provided at the transfer position (formation position), at the transfer position (formation position), the position of the conveying reference end surface of the sheet 38 coincides with the position of the reference surfaces 68A of the conveying reference members 68, and, by using the position of the conveying reference end surface of the sheet 38 at the transfer position (formation position) as a reference, the image formation reference position is set at a position that is apart from the position of the conveying reference end surface by a distance corresponding to the sheet width measured value w. Therefore, the formation positions on the sheet 38 of the marks 92 for color offset correction, the images, and the page position prescribing marks 90 fluctuating in accordance with the actual width of the sheet 38 is suppressed, and in addition, the formation positions on the sheet 38 of the marks 92 for color offset correction, the images, and the page position prescribing marks 90 fluctuating in accordance with meandering of the sheet 38 or the like also is suppressed. Note that the image formation reference position in the above-described aspect is an example of the formation reference position, and the conveying reference members 68 are an example of the collision member.

Although the above describes an aspect in which measurement of the sheet width is carried out at the image forming devices 14, 18 respectively, the present invention is not limited to the same and may be structured such that measurement of the sheet width is carried out only at the image forming device 14 at the upstream side, and the image forming device 18 at the downstream side receives the sheet width measured value w from the image forming device 14.

Further, the above describes, as an example of the index of a shape having "a portion whose length along the first direction varies continuously along the second direction", the marks 92 for color offset correction that include the first mark 94K, whose length direction runs along the sheet transverse direction (the main scanning direction), and the plural second marks 96K, whose length direction is inclined so as to form angle θ with respect to the sheet conveying direction (the subscanning direction) (the interval between the first mark 94K and the second mark 96K corresponds to an example of the above-described portion). However, the index of a shape having the above-described portion is not limited to the marks 92 for color offset correction, and a mark of another shape may be applied, such as for example a triangular mark that includes a first side that runs along the sheet transverse direction (the main scanning direction), and a second side that is inclined with respect to the sheet transverse direction (the main scanning direction) and the sheet conveying direction (the subscanning direction), or the like.

Further, an aspect is described above in which the present invention is applied to the image forming devices 14, 18 that are structured so as to form images of plural colors and superpose the images of the plural colors one on top of another on a sheet. However, the image forming device relating to the present invention may be structured so as to, after superposing images of plural colors one on another on an intermediate transfer body, transfer the superposed images onto a sheet. Moreover, although the image forming devices 14, 18 are structured so as to form and superpose images of four colors (K, C, M, Y), the number of colors of images that are superposed may be greater than four or less than four, and application to an image forming device that forms an image of a single color is also included within the scope of the present invention.

Moreover, the above describes an aspect that structures an image forming system 10 in which the sheet reversing device 16 is provided between the two image forming devices 14, 18 that are examples of the image forming device relating to the present invention, and images are formed on both surfaces of the sheet 38. However, the present invention is not limited to the same. The present invention may be applied to an image forming device that is used independently for the purpose of forming images on only one side of a recording medium such as a sheet or the like. Or, the present invention may be applied to an image forming device that is structured so as to independently form images on both sides of a recording medium such as a sheet or the like. When forming an image on only one surface of a recording medium such as a sheet or the like, the formation of the page position prescribing marks 90 onto the recording medium such as a sheet or the like, that was described above, is omitted.

Further, although the above describes an aspect in which the present invention is applied to the image forming devices 14, 18 that form images by the electrophotographic method, the present invention is not limited to the same, and can be applied to image forming devices that form images by the inkjet method or another known method.

Still further, although an elongated, continuous sheet (the sheet 38) is described above as an example of the recording medium relating to the present invention, the present invention is not limited to the same. The recording medium relating to the present invention may be, for example, a sheet that is cut in advance into a page unit, or may be a medium other than paper such as an OHP sheet or the like.

An aspect is described above in which the mark formation position computing processing and the sensor position control processing are realized by the mark formation position computing program and the sensor position control program being executed by the main body control portions 80 of the image forming devices 14, 18. However, the present invention is not limited to the same, and may be structured such that the above-described respective processings are realized by hardware.

Moreover, the above describes an aspect in which the mark formation position computing program and the sensor position control program, that serve as control programs of the image forming device relating to the present invention, are stored in advance (installed) in the storage portion 80C that serves as the recording medium of the main body control section 80 of the image forming device 14, 18, and the correction amount computing program is stored in advance in a non-volatile memory that is built-in the correction amount computing section 82. However, the control programs of the image forming device relating to the present invention may be provided in a form of being recorded on a recording medium such as a CD-ROM, a DVD-ROM, a flash memory, or the like.

What is claimed is:

1. An image forming device comprising:

a forming component that forms an index, at a formation position, on a recording medium that is conveyed in a first direction and passes the formation position;

an acquiring component that acquires measurement results, from a measuring component, of a width, in a second direction that intersects the first direction, of the recording medium on which the index is formed by the forming component;

a formation control component that carries out control that causes the index to be formed by the forming component at a position that is at one end portion side, along the second direction, of the recording medium, and that is apart, along the second direction and by a distance corresponding to the width acquired by the acquiring component, from a formation reference position that is set at another end portion side, along the second direction, of the recording medium;

a detecting component that, at a detection position that is further toward a downstream side in a conveying direction of the recording medium than the formation position, detects the index formed on the recording medium;

a moving component that moves, along the second direction, a detection range in which the detecting component can detect the index;

a sensing component that senses an offset amount, along the second direction, between the detection range of the detecting component and a position of the index formed on the recording medium, at the detection position; and a movement control component that carries out control that moves the detecting component by the moving component, in accordance with the offset amount sensed by the sensing component, wherein the index is a shape that has a portion whose length along the first direction varies continuously along the second direction, and on the basis of a length of the portion of the index detected by the detecting component, the sensing component senses the offset amount, along the second direction, between the detection range and the position of the index.

2. The image forming device of claim 1, wherein a plurality of the forming components are provided, and the respective forming components form indices of colors that differ from one another on the recording medium, and form images of colors that differ from one another on the recording medium by using, as references, formation positions of the indices on the recording medium, the detecting component detects respective positions of the indices of colors that differ from one another and that are respectively formed on the recording medium by the plurality of forming components, and the image forming device further comprises a correction control component that, on the basis of the positions of the indices of the respective colors that are detected by the detecting component, and by using, as a reference, the position of an index of a preset reference color, carries out control that corrects formation positions of the indices, with respect to the forming components that are objects of correction and that form the indices of colors other than the reference color.

3. The image forming device of claim 2, wherein the formation control component carries out, with respect to each of the plurality of forming components, control for causing the index to be formed at the position that is apart, along the second direction and from the formation reference position, by a distance corresponding to the width, and the sensing component senses an offset amount, along the second direction, between the detection range of the detecting component and a position of the index of any one color formed on the recording medium, at the detection position.

4. The image forming device of claim 2, further comprising a collision member that, at a collision position that is further toward an upstream side in the conveying direction of the recording medium than the formation position, one end portion along the second direction of the recording medium that passes the collision position collides against, wherein the plurality of forming components are provided in order along the conveying direction of the recording medium, and a color of an index, that is formed by the forming component that is provided at a position that is furthest upstream in the conveying direction of the recording medium among the plurality of forming components, is set to be the reference color.

5. The image forming device of claim 1, wherein the measuring components are disposed respectively at a plurality of different positions along the conveying direction of the recording medium, and respectively optically measure the width of the recording medium, and the acquiring component selects, as the measurement results of the width, a maximum value of measured values of the width of the recording medium that the acquiring component acquires from the plurality of measuring components respectively.

6. The image forming device of claim 1, further comprising a collision member that, at a collision position that is further toward an upstream side in the conveying direction of the recording medium than the formation position, one end portion along the second direction of the recording medium that passes the collision position collides against, wherein the formation reference position is set by using, as a reference, a position of the collision member along the second direction of the recording medium at the collision position.

7. The image forming device of claim 6, wherein, when the formation reference position is positioned at a same side as the collision member along the second direction with respect to the recording medium, the formation reference position is set at a position that is separated by a preset distance along the second direction from the position of the collision member, and, when the formation reference position is positioned at a side opposite the collision member along the second direction with respect to the recording medium, the formation reference position is set at a position that is apart, along the second direction and from the position of the collision member, by a distance corresponding to the width acquired by the acquiring component.

8. The image forming device of claim 1, wherein the formation reference position is set by using, as a reference, a position of an end portion, along the second direction, of the recording medium at the formation position.

9. The image forming device of claim 8, further comprising a collision member that, at the formation position, one end portion along the second direction of the recording medium that passes the formation position collides against, wherein the formation reference position is set, as a position of an end portion along the second direction of the recording medium at the formation position, by using, as a reference, a position of the collision member along the second direction of the recording medium at the formation position.

10. An image forming system comprising:

a first image forming device that is the image forming device of claim 1;

a reversing device that reverses an obverse and a reverse of the recording medium that is discharged from the first image forming device; and a second image forming device that is the image forming device of claim 1, wherein when an index that prescribes an image formation region is not formed in advance at one end portion along the second direction of the recording medium that is elongated and is supplied from a supplying device, the first image forming device forms an index that prescribes the image formation region by the forming component at a position that is at one end portion along the second direction on the obverse of the supplied, elongated recording medium and that corresponds to the width measured by the measuring component, and forms an image by the forming component at a position corresponding to a formation region of the index that prescribes the image formation region on the obverse of the elongated recording medium, and the second image forming device has a formation position index detecting component that detects the index that prescribes the image formation region that is formed on the recording medium supplied from the reversing device, and forms an image by the forming component at a position, that corresponds to a formation region of the index the prescribes the image formation region that was detected by the formation position index detecting component, on the reverse of the recording medium that is supplied from the reversing device.

11. The image forming system of claim 10, wherein, for each of the first image forming device and the second image forming device, the measuring component of the device comprises a plurality of sensors, and wherein one sensor of the plurality of sensors measures a first width of the recording medium and another sensor of the plurality of sensors measures a second width of the recording medium, and the acquiring component of the device compares the first width and the second width, and sets as the width of the recording medium whichever of the first width and the second width is greater.

12. The image forming device of claim 1, wherein the measuring component comprises a plurality of sensors, and wherein one sensor of the plurality of sensors measures a first width of the recording medium and another sensor of the plurality of sensors measures a second width of the recording medium, and the acquiring component compares the first width and the second width, and sets as the width of the recording medium whichever of the first width and the second width is greater.

13. The image forming device of claim 1, further comprising:

a memory;

wherein the measuring component comprises a plurality of sensors, and wherein one sensor of the plurality of sensors measures a first width of the recording medium and stores the first width in the memory, and another sensor of the plurality of sensors measures a second width of the recording medium, and the acquiring component reads the first width from the memory and compares the first width and the second width, and sets as the width of the recording medium whichever of the first width and the second width is greater.

14. The image forming device of claim 13, wherein the another sensor and the one sensor are provided at positions that are offset in the first direction.

15. The image forming device of claim 1, wherein the recording medium is an elongated continuous sheet.

16. A storage medium readable by a computer, the storage medium storing a program of instructions executable by a computer that is used in an image forming device that includes a forming component that, at a formation position, forms an index on a recording medium that is conveyed in a first direction and passes the formation position, the program causing the computer to function:

an acquiring component that acquires measurement results, from a measuring component, of a width, in a second direction that intersects the first direction, of the recording medium on which the index is formed by the forming component; and a formation control component that carries out control that causes the index to be formed by the forming component at a position that is at one end portion side, along the second direction, of the recording medium and is apart, along the second direction and by a distance corresponding to the width acquired by the acquiring component, from a formation reference position that is set at another end portion side, along the second direction, of the recording medium, wherein the image forming device further comprises:

a detecting component that detects, at a detection position that is further toward a downstream side in a conveying direction of the recording medium than the formation position, the index formed on the recording medium, and a moving component that moves, along the second direction, a detection range the detecting component to detect the index, and the program causes the computer to further function as:

a sensing component that senses an offset amount, along the second direction, between the detection range by the detecting component and a position of the index formed on the recording medium, at the detection position, and a movement control component that carries out control that moves the detecting component by the moving component, in accordance with the offset amount sensed by the sensing component, and wherein the index is a shape that has a portion whose length along the first direction varies continuously along the second direction, and on the basis of a length of the portion of the index detected by the detecting component, the sensing component senses the offset amount, along the second direction, between the detection range and the position of the index.

17. The storage medium of claim 16, wherein the measuring component comprises a plurality of sensors, and wherein one sensor of the plurality of sensors measures a first width of the recording medium and another sensor of the plurality of sensors measures a second width of the recording medium, and the acquiring component compares the first width and the second width, and sets as the width of the recording medium whichever of the first width and the second width is greater.

* * * * *